United States Patent [19]

Garrett

[11] Patent Number: 4,615,401

[45] Date of Patent: Oct. 7, 1986

[54] AUTOMATIC HYDRAULIC THRUSTER

[75] Inventor: William R. Garrett, Houston, Tex.

[73] Assignee: Smith International, Newport Beach, Calif.

[21] Appl. No.: 737,577

[22] Filed: May 24, 1985

Related U.S. Application Data

[63] Continuation of Ser. No. 624,794, Jun. 26, 1984, abandoned, which is a continuation-in-part of Ser. No. 436,187, Oct. 22, 1982, abandoned.

[51] Int. Cl.[4] ..... E21B 34/00; E21B 4/18

[52] U.S. Cl. ..... 175/230; 137/864; 175/325; 175/94

[58] Field of Search ..... 175/230, 325, 51, 61, 175/62, 73; 166/206, 212, 332; 137/625.5, 625.27, 864, 871

[56] References Cited

U.S. PATENT DOCUMENTS

| | | | |
|---|---|---|---|
| 1,784,705 | 12/1930 | Olsen | 137/864 |
| 2,314,860 | 3/1943 | Lenin | 137/864 X |
| 3,088,532 | 5/1963 | Kellner | 175/230 |
| 3,105,561 | 10/1963 | Kellner | 175/230 |
| 3,138,214 | 6/1964 | Bridwell | 175/230 |
| 3,180,437 | 4/1965 | Kellner et al. | 175/230 |
| 3,225,843 | 12/1965 | Ortloff et al. | 175/230 X |
| 3,225,844 | 12/1965 | Roberts | 175/230 |
| 3,298,449 | 1/1967 | Bachman et al. | 175/230 X |
| 3,399,738 | 9/1968 | Haspert | 175/94 X |
| 3,797,589 | 3/1974 | Kellner et al. | 175/94 |
| 3,799,277 | 3/1974 | Kellner | 175/230 X |
| 3,827,512 | 8/1974 | Edmond | 175/230 X |
| 3,978,930 | 9/1976 | Schroeder | 175/230 X |
| 4,040,494 | 8/1977 | Kellner | 175/94 X |
| 4,205,784 | 6/1980 | Monigold | 137/864 X |

*Primary Examiner*—Stephen J. Novosad
*Assistant Examiner*—Thuy M. Bui
*Attorney, Agent, or Firm*—Murray Robinson; Anastassios Triantaphyllis; David A. Rose

[57] ABSTRACT

Automatic Hydraulic Thruster for hole boring including a mandrel and sleeve forming two expandable chambers with plural wall anchor means annularly disposed about the sleeve responsive to pressure differential between one chamber and the bore hole pressure and three-way valve means for automatically connecting the chambers respectively first with mandrel pressure and bore hole pressure and then vice versa.

24 Claims, 5 Drawing Figures

2
52
7
5
10
A
10a

AUTOMATIC HYDRAULIC THRUSTER

This is a file wrapper continuation of pending application Ser. No. 624,794, filed on June 26, 1984 now abandoned, which is a file wrapper continuation-in-part of application Ser. No. 436,187 filed on Oct. 22, 1982, now abandoned. Pending application Ser. No. 623,804, filed on June 22, 1984, is a continuation of application Ser. No. 436,187, now abandoned.

BACKGROUND OF THE INVENTION

This application discloses alternatives to and improvements upon the apparatus disclosed in U.S. Pat. Nos.: 3,298,449—Bachman, Moore, Rollins & Garrett 1967; 3,399,738—Haspert; 3,797,589—Kellner & Alther; 3,799,277—Kellner; 4,040,494—Kellner 1977; 4,040,495—Kellner & Garrett 1977; assigned to the same assignee as the present application, the disclosures of which are incorporated herein by reference and the art cited in which may also be referred to for the background of the invention.

The hydraulic thruster has a primary use for applying a force to an earth boring drill bit. A typical application would be to use in directional drilling when the hole angle approaches horizontal. In these situations most of the drill collar or drill stem weight is directed toward the low side of the hole and very little is left for available bit thrust.

This device can make a valuable contribution at this time, because of the high cost of offshore well platforms. It is important for best economics to drill wells a great distance horizontally from each platform to drain as much of the reservoir as possible with a minimum number of platforms. This is known as extended reach drilling. Conventional drilling becomes impractical when the hole wall friction becomes too great and the length of drill stem that must be run in compression for effective bit thrust exceed design limits. There are many other applications where the surface platform must be substantially removed from the hole bottom in the reservoir such as in arctic regions, mountains, and near large cities.

SUMMARY OF THE INVENTION

The device has an outer sleeve assembly and an inner mandrel assembly. Each assembly is made of individual elements attached together with threaded connections. Each asssembly can be rotated with respect to the other and is slidable from approximately a few inches up to several feet with stop limits at each end of the stroke.

There are two separate hydraulic chambers between the outer sleeve and inner mandel assembly. A valve mechanism can alternately change the ports of the hydraulic chambers so that one hydraulic chamber can be opened up to the pressure in the drill stem annulus. These ports are reversed at the end of each stroke. There is typically from a few hundred to several thousand pounds per square inch pressure between the inside of the drill stem and the outside.

In one of the hydraulic chambers, is a set of wall anchor pistons. When this chamber is subjected to high pressure, the pistons act like hydraulic jacks to attach and hold the outer sleeve rigidly to the hole wall.

In the sequence of operations, high pressure is fed into the chamber with the wall anchor pistons. In this position the outside sleeve is held against the hole wall and high pressure is applied to the thrust piston of the inner mandrel. The other hydraulic chamber has low pressure. Thrust is applied to the bit and the bit is drilling forward. The inner mandrel assembly is attached to the drill string at each end. The bit may be rotated by rotating the drill stem at the surface with a kelly or power swivel. An alternate would be to rotate with a down-hole motor which could be positioned between the thruster and the bit. The reactive force of the bit is taken by the wall anchor piston which is forced against the hole wall. When the bit drills the stroke of axial movement of the two members, the valving mechanism reverses the high and low pressure openings of the two chambers. The wall anchor pistons are released from gripping the hole wall. Pressure reverses on the thrust piston. The drill bit temporarily stops drilling as the outer sleeve moves forward toward the bit to reset for another drilling stroke. The time for the resetting stroke is very small so that most of the total operating time is spend drilling. An alternative embodiment of the present invention has an inner mandrel, a barrel surrounding the mandrel and a sub surrounding the mandrel and a portion of the barrel. Two hydraulic chambers are formed between the inner mandrel and the barrel and the sub, a thrusting chamber and a resetting chamber. A first set of anchor means or barrel anchor means is in fluid communication with the thrusting chamber and a second set of anchor means or mandrel anchor means is in fluid communication with the resetting chamber. When high pressure is fed into the thrusting chamber and low pressure into the resetting chamber by a valve mechanism, the barrel anchor means expands to grip the wall to keep the barrel stationary while the inner mandrel under a force exerted thereon by the pressure differential between the high pressure in the thrusting chamber and the low pressure surrounding the apparatus moves forward towards the closed end of the borehole to apply a thrust on the drill bit. After the mandrel travels a predetermined distance, the valve mechanism automatically reverses and feeds high pressure into the resetting chamber and low pressure into the thrusting chamber to stop the thrusting operation and to commence the resetting operation. The barrel anchor means are retracted by rubber bands, the mandrel anchor means are expanded to grip the wall to maintain the mandrel stationary and the barrel moves forward under a force exerted thereon by the differential pressure between the resetting chamber and the thrusting chamber. When barrel moves forward a predetermined distance, the valve mechanism automatically reverses to stop the resetting operation and to commence the thrusting operation. The barrel and the mandrel anchor means include shoes connected to pistons that move in and out radially under hydraulic pressure to cause the shoes to engage the wall of the earth borehole. The piston includes a body having an annular recess, a sleeve surrounding the body having internal flange extending into the annular recess of the body and resilient means between the body and the sleeve.

BRIEF DESCRIPTION OF THE DRAWINGS

FIGS. 3A, 3B, 3C, and 3D together form an axial section through an automatic thruster according to another embodiment of the invention, showing the automatic thruster in a thrusting position;

FIG. 3BB is an enlargement of axial section 3BB of FIG. 3B;

FIGS. 4A, 4B, 4C and 4D together form an axial section through the automatic thruster shown in FIGS. 3A, 3B, 3C and 3D showing the automatic thruster in a resetting position;

FIGS. 5, 6, 7, 8, 9, 10, 11, 12 and 13 are transverse sections taken through the automatic thruster shown in FIGS. 3A, 3B, 3C and 3D, such sections being taken on the planes indicated in FIGS. 3A, 3B, 3C and 3D;

FIG. 14 is a partial cross section of the automatic thruster shown in FIGS. 3A, 3B, 3C and 3D taken on line 14—14 of FIG. 11;

FIG. 15 is a partial cross section of the automatic thruster shown in FIGS. 3A, 3B, 3C and 3D taken on line 15—15 of FIG. 11;

FIG. 16 is a partial axial cross section of another embodiment of the automatic thruster shown in FIGS. 3A, 3B, 3C and 3D; and FIG. 17 is transverse sections taken through the automatic thruster shown in FIG. 16, such sections being taken on the planes indicated in FIG. 16.

Figure 1A:
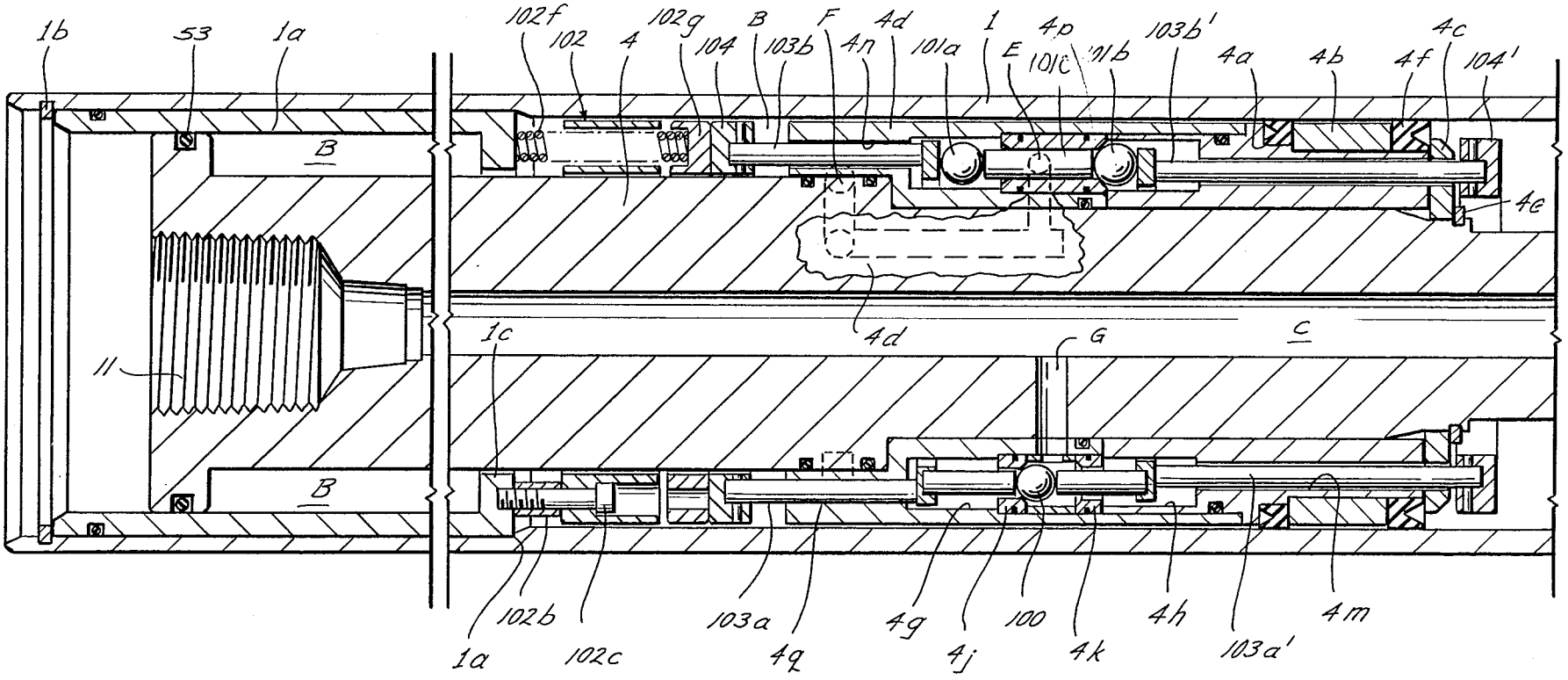
FIGS. 1A and 1B, sometimes hereinafter referred to collectively as FIG. 1, together form an axial section through an automatic thruster in accordance with the invention showing the thruster in extended position.
Figure 1B:
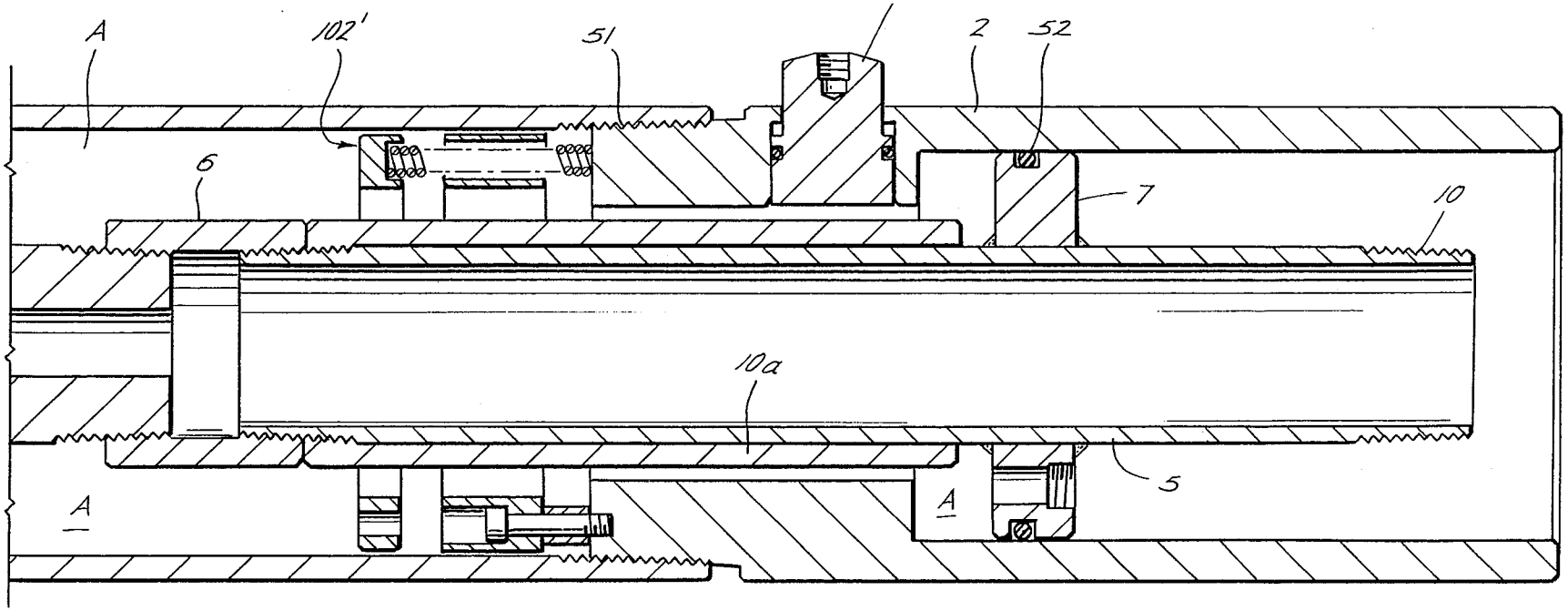

DETAILED DESCRIPTION OF PREFERRED EMBODIMENT (a) Inner Mandrel, Outer Sleeve, and Anchor Pistons Now referring to FIG. 1, there is shown the thruster in the drilling or extended position. The anchor pistons 3 are pressed against the hole wall (not shown) and the high pressure is on the bit thrust piston 4*a*–4*f*.

Referring to FIG. 1, Item 1, is the lower cylinder, and 2 is the upper cylinder. Items 1 and 2, are screwed together at 51 and form the outer sleeve. Item 3, is one of several hole wall anchor pistons and is positioned in a window in upper cylinder 2, similar to the construction of the anchor barrel in U.S. Pat. No. 3,799,277.

Items 4 and 5, are tubular mandrel sections connected together with threads by a tubular coupling Item 6. Items 4, 5, and 6, form the inner mandrel assembly. Threads 11 on Item 4, are to be screwed into the lower drill stem (not shown) toward the bit. Threads 10 on tubular mandrel section 5, are to be screwed into the upper part of the drill stem (not shown). Item 10*a* is a sleeve concentric with mandrel section 5 and functions only as a spacer to keep anchor pistons 3 from retracting too far.

(b) Pressure chambers

When chamber A (extending between the sleeve and mandrel from the O-ring seal 52 therebetween, on seal support ring 7 secured to the mandrel, to piston 4*a*–4*f*) is supplied with high pressure from mandrel bore C through radial port G in the mandrel, the wall anchor pistons grip the hole wall and thrust is put on the bit by piston 4*a*–4*f*. Chamber B (extending between the sleeve and mandrel from the O-ring seal 53 therebetween to piston 4*a*–4*f*) has low pressure at this time as drilling is being done. High pressure is imposed on piston 4*a*–4*f*, secured to the mandrel by ring 4*c* and snap ring 4*e*, and on the seal 4*f* at the end of seal back-up ring 4*b*, also held to piston 4*a* by ring 4*c*.

(c) Three way valves

Intake pressure ball valve 100, being in a pocket formed by bores 4*g*, 4*h* in telescope piston sections 4*a*–4*f*, is held against the valve seat 4*j* toward chamber B forcing pressure from port G into chamber A via valve seat 4*k* and piston bore 4*m*. Exhaust pressure ball valve 101*a* (in a similar pocket in piston 4*a*–4*f*) is held open to allow escape of fluid from chamber B via piston bore 4*n* to low pressure. The fluid channel escape route is through port F. The bore C through the inner mandrel is continuous. Port F is vented to the outside annulus for low pressure exhaust.

(d) Valve action

FIG. 1 shows the inner mandrel and thrust piston 4*a*–4*f* close to the end of the stroke. Piston 4*a*–4*f* is larger in diameter than seals 52 (and 53) so that it is causing forward motion of the bit. A small additional movement forward causes ring 104 to compress springs in spring assembly 102. Spring assembly 102 comprises plural bored annular guide ring 102*a*, held spaced from outer sleeve shoulder 1*a* by spacer tubes 102*b* and cap screws 12*c* screwed into the radial flange 1*c* on sleeve bushing 1*a* (secured to the sleeve by snap ring 1*b*), and plural helical springs 102*f* in the guide ring bores, and plural socket spring cover ring 102*g*. When the springs are sufficiently compressed, the spring force will exceed the pressure differential force acting on ball valves 100 and 101*b*. High pressure in chamber A entering via bore 4*m* seats ball 101*b* on valve seat 4*p* and pushes through rod 101*c* and ball 101*a* against the rod 103*b* overcoming low pressure in B tending to unseat ball 101*b*. When the balls 101*b* are slightly unseated the reduced pressure differential will allow the springs in the spring assembly to push against ring 104 and push rods 103*a* and 103*b* causing a quick action reversal of the balls against the respective seats. Ball 100 will move quickly to the opposite seat 4*k* allowing high pressure to go into chamber B via valve seat 4*j* and bore 4*g*, and prevent high pressure from going into chamber A via seat 4*k*. Exhaust ball valve 101*b* will be unseated to allow fluid in chamber A to exhaust into low pressure bore C through ports E and F. Ball valve 101*a* will be seated to prevent high pressure fluid now in chamber B from escaping.

In this position the wall anchor pistons 3 release the grip from the hole wall and high pressure is on the opposite side of thrust piston 4*a*–4*f*. The outer sleeve assembly is pushed forward by the high pressure in chamber B acting on sleeve bushing 1*a*, thus resetting for drilling another stroke.

Figure 2A:
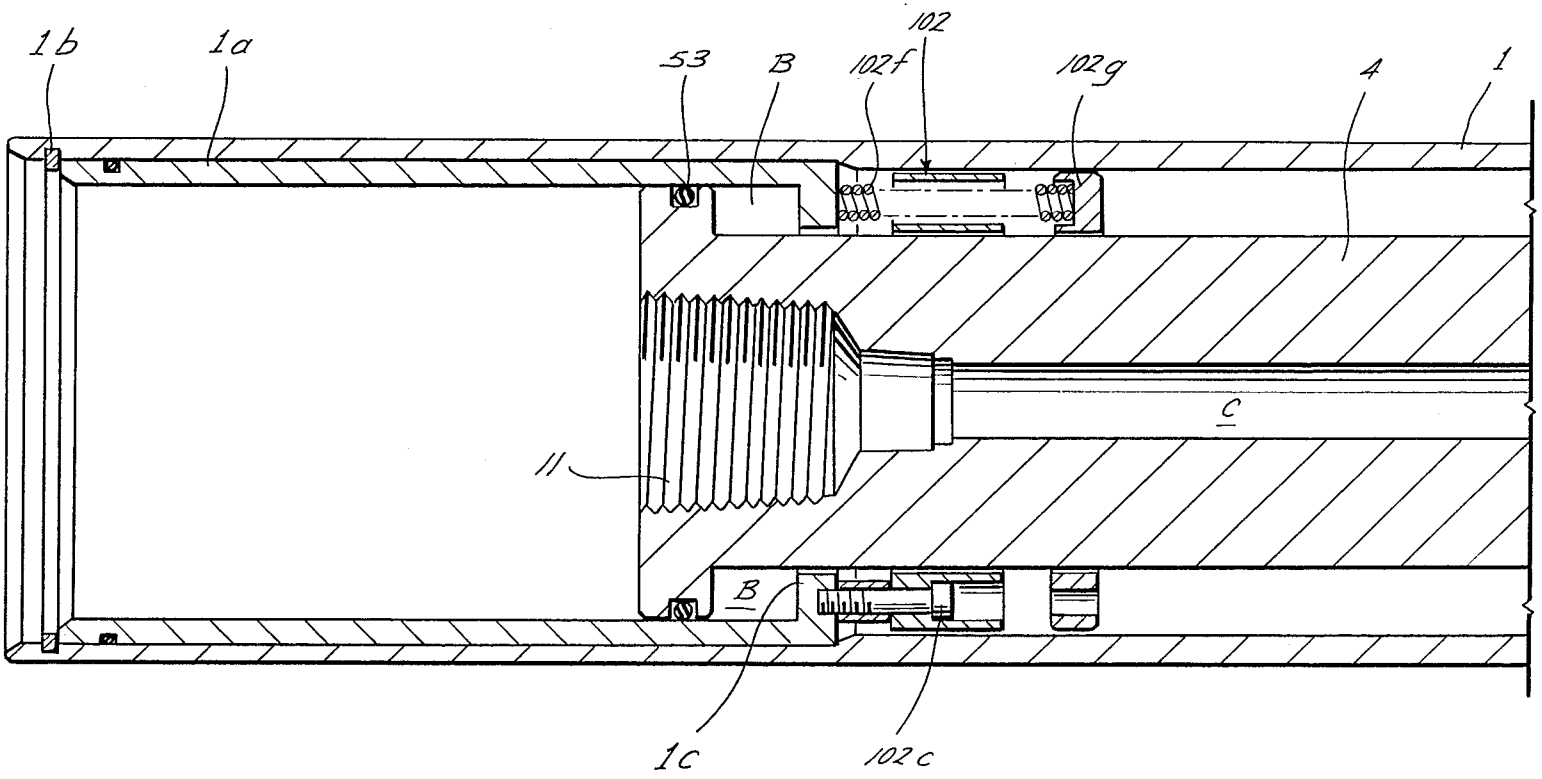
FIGS. 2A, 2B, and 2C, sometimes hereinafter referred to collectively as FIG. 2, together form an axial section like FIGS. 1A and 1B, except that the thruster is in retracted position.
Figure 2B:
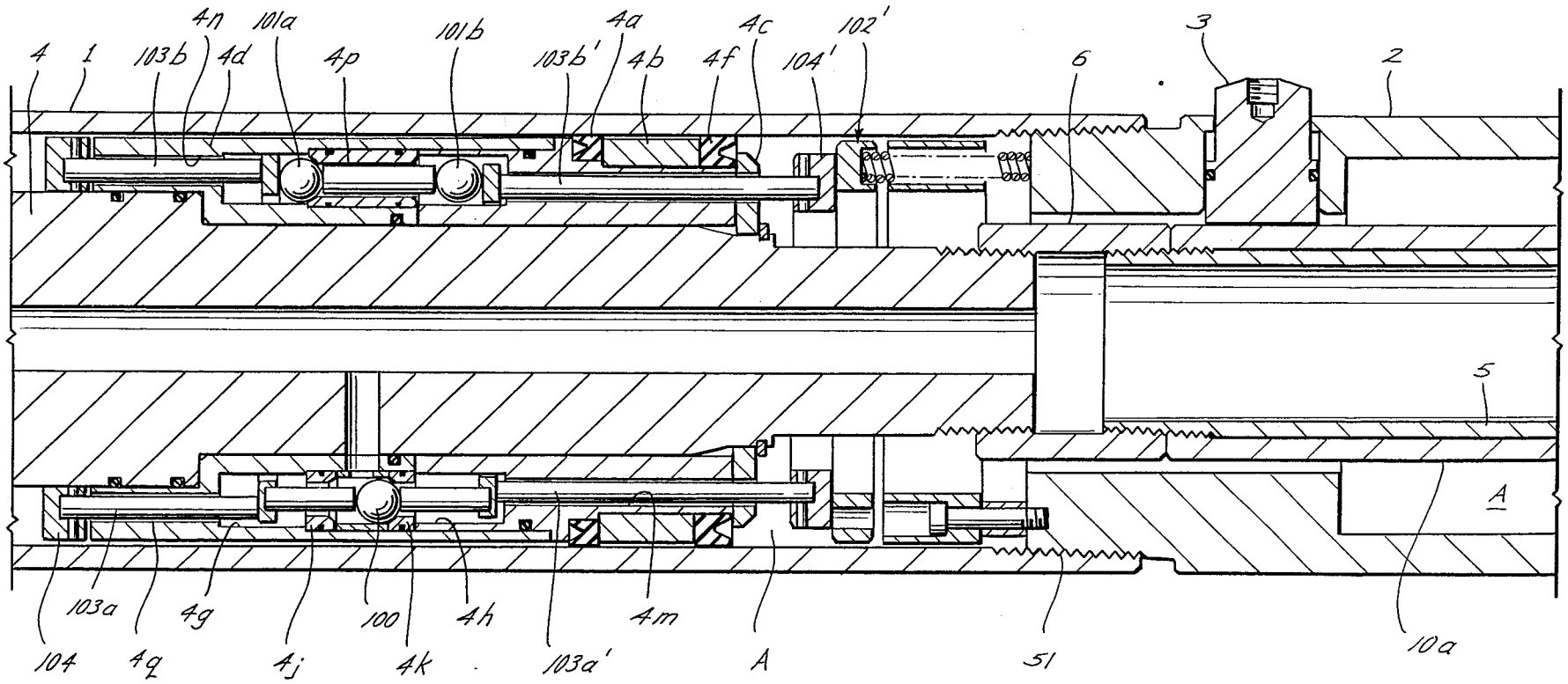

The latter position of ball valves, push rods, and port openings are shown in FIG. 2.

When the outer sleeve gets to the end of its resetting movement, a spring assembly 102', identical to assembly 102 except at the opposite end in chamber A, will push on a ring 104' like ring 104 and push rods 103*a*' and 103*b*' (similar to those described) and cause a reversal of the valves and porting of high and low pressure fluid. The thruster is then ready for another stroke to drill hole.

Referring now to FIGS. 3A–D there is shown an alternative embodiment of the present invention showing automatic hydraulic thruster 190 in thrusting position, hereinafter described, having an inner mandrel 200, a barrel 202, a sub 204, a valve means 206, a barrel anchor means 208 and a mandrel anchor means 210. Inner mandrel 200 includes a first mandrel portion 200A, a second mandrel portion 200B, a third mandrel portion 200C and a fourth mandrel portion 200D. Mandrel portions 200A, B, C and D are connected in series by threaded connections, hereinafter described. Inner mandrel 200 is connected on one end to drill string 230 and on the ohter end to a drill bit (not shown) for drilling a borehole and has a flowbore 231 providing fluid communication between drill string 230 and the drill bit.

First mandrel portion 200A includes a reduced outside diameter portion 212 for receiving and attaching thereto a first marine bearing 214, hereinafter described and a further reduced outside diameter portion 216 for receiving swivel packing means 218 retained thereon by retainer ring 220 threaded onto exterior thread 222 of first mandrel portion 200A. Snap ring 224 prevents retainer ring 220 from coming loose from its threaded connection with first mandrel portion 200A. Furthermore, first mandrel portion 200A includes a threaded tapered box end 232 to provide a threaded connection with second mandrel portion 200B.

Second mandrel portion 200B is a tubular member of uniform thickness having a threaded tapered pin end 234 for a threaded connection with box end 232 of first mandrel portion 200A and another threaded tapered pin end 236 for a threaded connection with a coupling 238. Coupling 238 includes a threaded tapered box 240 in one end for a threaded connection with pin end 236 and a threaded tapered box 242 on the other end for a threaded connection with third mandrel portion 200C. Furthermore, coupling 238 has a reduced outside diameter portion 244 receiving a marine bearing 246 that is retained thereon by snap ring 248. The outside diameter of second mandrel portion 200B is smaller than the outside diameter of box end 232 of first mandrel portion 200A, whereby an annular shoulder 249 is formed.

Third mandrel portion 200C is a tubular member having uniform thickness and includes a flange or valve actuator 250, a radial port 252 providing fluid communication between interior surface 254 and exterior surfaces 256 of third mandrel portion 200C, a threaded pin end 258 for a threaded connection with box end 242 of coupling 239 and a threaded pin end 260 for a threaded connection with fourth mandrel portion 200D.

Fourth mandrel portion 200D is a tubular member having a flange 262 for providing a stop shoulder for a ball bearing 264 received over fourth mandrel portion 200D and retained thereon by a retainer ring 266 threaded onto an exterior thread of fourth mandrel portion 200D and a snap ring 270 preventing retainer ring 266 from coming loose. Fourth mandrel portion 200D has a reduced outside diameter portion 272 for receiving swivel packing means 274, 276 retained thereon by retainer ring 278 threaded onto exterior threaded surface 280 of fourth mandrel portion 200D and a snap ring 282 preventing retainer ring 278 from coming loose. Furthermore, fourth mandrel portion includes a box end 288 for a threaded connection with pin end 260 of third mandrel portion 200C and a threaded pin end 290 for a threaded connection with box end 292 of drill string 230.

As discussed above, mandrel portions 200A, B, C and D are threadingly connected in series to form inner mandrel 200. Inner mandrel 200 is connected to a drill bit or a hydraulic motor turning a drill bit (not shown) and drill string 230 via first mandrel portion 200A and fourth mandrel portion 200D, respectively. Therefore, drill string 230, inner mandrel 200 and the drill bit (not shown) form an interconnected assembly whereby rotation of drill string 230 causes simultaneous rotation of mandrel 200 and the drill bit and axial movement of inner mandrel 200 causes simultaneous axial movement of drill string 230 and the drill bit.

Barrel 202 includes a first barrel portion 202A, a second barrel portion 202B, a third barrel portion 202C, a fourth barrel portion 202D and a fifth barrel portion 202E. First barrel portion 202A is a tubular member of uniform thickness having a free end 294 and a threaded box end 296 for a threaded connection with threaded pin 298 of second barrel portion 202B.

Second barrel portion 202B includes another pin thread 299 for a threaded connection with third barrel portion 202C, sockets 300 and windows 302 for housing barrel anchor means 208, hereinafter described. Furthermore, second barrel portion 202B includes reduced inside diameter portions 304, 306, 308 for housing marine bearings 310, 312, 314, respectively, bondingly attached thereto, hereinafter described.

Third barrel portion 202C is a tubular member of uniform thickness having a threaded box end 318 for a threaded connection with pin end 299 of second barrel portion 202B and another threaded box end 320 for a threaded connection with valve means 206, hereinafter described. Fourth barrel portion 202D includes a threaded box end 322 for a threaded connection with valve means 206, hereinafter described, and a threaded box end 324 for a threaded connection with fifth barrel portion 202E.

Fifth barrel portion 202E includes a threaded pin end 326 for a threaded connection with box end 324 of fourth barrel portion 202D, a free annular end 326, a reduced outside diameter portion 328 for housing marine bearing 330 bondingly attached thereto, hereinafter described, a further reduced outside diameter portion 332 for receiving swivel packing means 334 retained thereon by retainer ring 336 threaded onto threaded exterior surface 338 of fifth barrel portion 202E and snap ring 340 preventing retainer ring 336 from coming loose.

As discussed above, barrel portions 202A, B, C, D and E and valve means 206, hereinafter described, are threadingly connected in series with valve means 206 being between third barrel portion 202C and fourth barrel portion 202D. Furthermore, barrel 202 has free ends 294, 326. Therefore, barrel 202 and valve means 206 are able to rotate or to move axially simultaneously as one piece.

Sub 204 includes a first sub portion 204A, a second sub portion 204B and a third sub portion 204C. First sub portion 204A includes a free end 344 and threaded box end 346 for a threaded connection with second sub portion 204B. Second sub portion 204B includes sockets 348 and windows 350 for housing mandrel anchor means 210, hereinafter described, increased inside diameter portions 352, 354 for housing marine bearing 355, 356, respectively, bondingly attached thereon, and a threaded pin end 358 for a threaded connection with third sub portion 204C.

Third sub portion 204C is a tubular member having a threaded box end 360 for a threaded connection with pin end 358 of second sub portion 204B, a free end 262, a radial port 364 adjacent free end 362 for removing cuttings and an annular internal flange 366 abutting ball bearing 264. Flange 366 and an insert piece 368, extending between end 370 of second sub portion 204B and ball bearing 264, prevent axial movement of ball bearing 264 relative to sub 204. Furthermore, as previously described, ball bearing 264 is not allowed to move axially relative to inner mandrel 200 by flange 262 and retainer ring 266. Therefore, it is apparent that ball bearing 264 allows rotational movement but prevents axial movement of inner mandrel 200 with respect to sub 204.

Referring now to FIG. 3BB there is shown an enlargement of portion 3BB of FIG. 3B for a detailed description of valve means 206. Valve means 206 includes a valve housing 374 for housing an intake valve 376 and an exhaust valve 378, valve sleeves 380, 580, intake valve thrust actuation means 382, intake valve reset actuation means 582, exhaust valve thrust actuation means 384, and exhaust valve reset actuation means 584.

Valve housing 374 has a central bore 386 being coaxial with valve housing 374 and diametrically opposite axial bores 388, 588. Axial bore 388 is in fluid communication with bore 386 via radial port 390 and axial bore 588 is in fluid communication with exterior cylindrical surface 392 of housing 374 via radial port 394. Valve housing 374 includes a threaded pin end 396 for a threaded connection with box end 320 of third barrel portion 202C and a threaded pin end 596 for a threaded connection with box end 322 of fourth barrel portion 202D. Valve housing 374 further includes a threaded box end 398 for a threaded connection with valve sleeve 380 and a threaded box end 598 for a threaded connection with valve sleeve 580.

Intake valve 376 comprises a three-way valve formed by axial bore 388, radial port 390, valve seats 402, 602 and a ball 400. Bore 388 includes a reduced diameter portion or internal flange 404 surrounding port 390. Valve seats 402, 602 are inserted in bore 388 for a snug fit therein abutting flange 404, thereby being maintained in a spaced apart position having mouth 408 of port 390 therebetween. O-ring seals 410, 610 provide sealing between axial bore 388 and valve seats 402, 602, respectively. Ball 400 having a diameter larger than the inside diameter of valve seats 402, 602 is located in axial bore 388 between valve seats 402, 602 and may move freely therebetween from resting on valve seat 402 to resting on valve seat 602. Spacer sleeves 412, 612 being coaxial with bore 388 and abutting valve seats 402, 602, respectively, prevent valve seats 402, 602 from being axially displaced away from flange 404. Spacer sleeves 412, 612 are retained thereon by retainer sleeve 414, 614 being threaded into threaded ends 416, 616 of bore 388 and abutting spacer sleeves 412, 612, respectively.

Exhaust valve 378 is a three-way valve formed by axial bore 588, radial port 394, valve seats 418, 618, balls 420, 620 and a ball displacing rod 422. Bore 588 includes a reduced inside diameter portion or internal flange 424 surrounding port 394. Valve seats 418, 618 are inserted in bore 588 for a snug fit therein abutting flange 424, thereby being maintained in a spaced apart position having mouth 428 of port 394 therebetween. Valve seats 418, 618 are retained in axial bore 588 by spacer sleeves 430, 630. Retainer sleeves 432, 632 threaded into threads 434, 634 of bore 588 abut spacer sleeves 430, 630 respectively, to prevent axial movement thereof. O-ring seals 436, 636 provide sealing engagement between bore 588 and exhaust valve seats 418, 618, respectively. Balls 420, 620 having a larger diameter than the inside diameter of valve seats 418, 618 are placed in bore 588 on exterior ends 438, 638 of valve seats 418, 618, respectively, and are allowed to float to and away from valve seats 418, 618, respectively. Ball displacing rod 422 is placed in bore 588, coaxially therewith, and it is sized to extend from exterior end 438 of valve seat 418 to exterior end 638 of valve seat 618. Displacing rod 422 is allowed to move axially within valve seats 418, 618, so that, when ball 420 moves to rest on seat 418 to close the flow passage therethrough, displacing rod 422 is displaced axially away from exterior end 438 of valve seat 418 and towards valve seat 618, thereby displacing ball 620 away from valve seat 618 and opening a flow passage therethrough. Displacing rod 422 is externally sized to be in intimate contact with valve seats 418, 618, thereby preventing any noticeable pivotal movement thereof. Fluid communication around displacing rod 422 through valve seats 418, 618 is provided by exterior axial flutes 440, circumferentially spaced thereon.

It should be noted that, although it is not necessary for the operation of automatic hydraulic thruster 190, the construction of certain corresponding components of intake valve 376 and exhaust valve 378 is identical. These components include valve seat 402 being identical with valve seats 602, 418 and 618, spacer sleeves 412 being identical to spacer sleeves 612, 430 and 630, retainer sleeve 414 being identical with retainer sleeves 614, 432 and 632 and ball 400 being identical with balls 420 and 620.

Referring now to FIGS. 3B and 3BB, valve sleeve 380 is a tubular member having a threaded pin end 442 for a threaded connection with threaded box end 398 of valve housing 374, an increased inside diameter portion 444 housing a marine bearing 446 bondingly connected thereto, and a further increased inside diameter portion 448 housing swivel packing means 450 retained thereby by retainer ring 458 threaded into threaded box end 454 of valve sleeve 380 and snap ring 456 for preventing retainer ring 452 from coming loose.

Similarly to valve sleeve 380, valve sleeve 580 is a tubular member having a threaded pin end 642 for a threaded connection with threaded box end 598 of valve housing 374, an increased inside diameter portion 644 housing a marine bearing 646 bondingly connected thereto, and a further increased inside diameter portion 648 housing swivel packing means 650 retained thereon by retainer ring 652 threaded into threaded box end 654 of valve sleeve 580 and snap ring 656 for preventing retainer ring 652 from coming loose.

Referring now again to FIG. 3BB, intake valve thrust actuation means 382 includes an elongated rod 462, a retracting coil spring 464, a pin 466, a snapping coil spring 468 having a higher force constant than retracting coil spring 464, and a valve actuation sleeve 470. Elongated rod 462 has a flange 472 dividing elongated rod 462 into a long portion 474 and a short portion 476. Long portion 474 includes a reduced diameter pin end 478 sized to penetrate valve seat 402. Retracting coil spring 464 is received over long portion 474 and inserted into bore 482 being formed by retainer sleeve 414, spacer sleeve 412 and valve seat 402, until first end 480 of spring 464 abuts flange 472 and second end 484 of spring 464 abuts an internal flange 486 formed in the interior of retainer sleeve 414. In that position, coil spring 464 is partially surrounded by retainer sleeve 414 and reduced diameter pin end 478 of partially penetrates valve seat 402 to be immediately adjacent ball 400 when ball 400 rests on valve seat 402. Snapping coil spring 468 is partially received over short portion 476 of elongated rod 462 on one end 488, abutting flange 472 and over pin 466 on the other end 490, abutting pin head 492 of pin 466. In that position, elongated rod 462, retracting coil spring 464, snapping coil spring 468 and pin 466 are coaxially aligned to facilitate the actuation of intake valve 376 for a thrusting operation, hereinafter described. Valve actuation sleeve 470 is a tubular member received over valve sleeve 380 having enlarged annular end 493 adjacent pin head 492 and pin head 792, hereinafter described, and keys 494, integrally attached thereto and adapted to slide axially in keyways 496. Keyways 496 have a limited length on the exterior of valve sleeve 380, thereby allowing limited axial movement of valve actuation sleeve 470 with respect to valve sleeve 380 but preventing rotational movement thereof with respect to valve sleeve 380.

Similarly to intake valve thrust actuation means 382, intake valve reset actuation means 582 includes an elongated rod 662, a retracting coil spring 664, a pin 666, a snapping coil spring 668, having a higher force constant than coil spring 664, and a valve actuation sleeve 670. Elongated rod 662 has a flange 672 dividing elongate rod 662 into a long portion 674 and a short portion 676. Long portion 674 includes a reduced diameter pin end 678 sized to penetrate valve seat 602. Retracting coil spring 664 is received over long portion 674 and inserted into bore 682 being formed by retainer sleeve 614, spacer sleeve 612 and valve seat 602, until first end 680 of coil spring 664 abuts flange 672 and second end 684 of coil spring 664 abuts an internal flange 686 formed in the interior of retainer sleeve 614. In that position, coil spring 664 is partially surrounded by retainer sleeve 614 and reduced diameter pin end 678 partially penetrates valve seat 602 to be immediately adjacent ball 400 when ball 400 rests on valve seat 602. Snapping coil spring 668 is partially received over short portion 676 of elongated rod 662 on one end 688, abutting flange 672 and over pin 666 on the other end 690, abutting pin head 692 of pin 666. In that position, elongated rod 662, retracting coil spring 664, snapping coil spring 668 and pin 666 are coaxially aligned to facilitate the actuation of intake valve 376 for a resetting operation, hereinafter described. Valve actuation sleeve 670 is a tubular member received over valve sleeve 580 and having enlarged annular end 693 adjacent pin head 692 and pin head 892, hereinafter described, and keys 694, integrally attached thereto and adapted to slide axially in keyways 696. Keyways 626 have a limited length on the exterior of valve sleeve 580, thereby allowing limited axial movement of valve actuation sleeve 670 with respect to valve sleeve 580, but preventing rotational movement thereof with respect to valve sleeve 580. Valve actuation sleeve 670 also includes an extension member 671 in one end secured thereto via roll pin 673 as shown in FIG. 2.

Still referring to FIG. 3BB, exhaust valve thrust actuation means 384 includes an elongated rod 762, a retracting coil spring 764, a pin 766, a snapping coil spring 768 and previously described valve actuation sleeve 470. Elongated rod 762 has a flange 772 dividing rod 762 into a long portion 774 and a short portion 776. Long portion 774 includes a reduced diameter pin end 778. Coil spring 764 is received over long porton 774 and inserted into bore 782 being formed by retainer sleeve 432, spacer sleeve 430 and valve seat 418, until first end 780 of coil spring 764 abuts flange 772 and second end 784 of coil spring 764 abuts an internal flange 786 formed in the interior of retainer sleeve 432. In that position, coil spring 764 is partially surrounded by retainer sleeve 432 and reduced diameter pin end 778 extends into bore 782 beyond flange 786 towards ball 420 to be immediately adjacent ball 420 when ball 620 rests on valve seat 618 and displacing rod 422 displaces ball 420 from resting on the valve seat 418. Snapping coil spring 768 is partially received over short portion 776 of elongated rod 762 on one end 788, abutting flange 772 and over pin 766 on the other end 790, abutting pin head 792 of pin 766. In that position, elongated rod 762, retracting coil spring 764, snapping coil spring 768 and pin 766 are coaxially aligned to facilitate the actuation of exhaust valve 378 for a thrust operation, hereinafter described.

Similarly to exhaust valve thrust actuation means 384, exhaust valve reset actuation means 584 includes an elongated rod 862, a retracting coil spring 864, a pin 866, a snapping coil spring 868 and previously describing valve actuation sleeve 670. Elongated rod 862 has a flange 872 dividing rod 862 into a long portion 874 and a short portion 876. Long portion 874 includes a reduced diameter pin end 878. Retracting coil spring 864 is received over long portion 874 and inserted into bore 882 being formed by retainer sleeve 632, spacer sleeve 630 and valve seat 618 until first end 880 of coil spring 864 abuts flange 872 and second end 884 of coil spring 864 abuts an internal flange 886 formed in the interior of retainer sleeve 632. In that position, coil spring 864 is partially surrounded by retainer sleeve 632 and reduced diameter pin end 878 extends into bore 882 beyond flange 886 towards ball 620 to be immediately adjacent ball 620 when ball 420 rests on valve seat 418 and displacing rod 422 displaces ball 620 from resting on valve seat 618. Coil spring 868 is partially received on one end 888 over short portion 876 of elongated rod 862, abutting flange 872 and on the other end 890 over pin 866, abutting pin head 892 of pin 866. In that position, elongated rod 862, retracting coil spring 864, snapping coil spring 868 and pin 866 are coaxially aligned to facilitate the actuation of exhaust valve 378 for a thrusting operation, hereinafter described.

It should be noted that, although it is not necessary for the operation of the automatic hydraulic thruster 190, the construction of the corresponding components of intake valve thrust actuation means 382, intake valve reset actuation means 582, exhaust valve thrust actuation means 384 and exhaust valve thrust actuation means 584 is identical except that pin ends 778, 878, of elongated rods 762, 862 are shorter than pin ends 478, 678 of elongated rods 462, 662. Therefore, elongated rod 462, except for the difference stated hereinabove, is identical with elongated rods 662, 762 and 862, retracting coil spring 464 is identical with retracting coil spring 664, 764 and 864, pin 466 is identical with pin 666, 766 and 866, snapping coil spring 468 is identical with snapping coil springs 668, 768 and 868 and valve actuation sleeve 470 is identical with valve actuation sleeve 570. Furthermore, it should be noted that retracting coil springs 464, 664, 764 and 864 should preferably have a spring force of 25 to 50 pounds at full compression and snapping coil springs 468, 668, 768 and 868 should preferably have a spring force of 300 to 400 pounds at full compression.

Referring now to FIG. 3C, barrel anchor means 208 includes two sets of shoes 702, in series, each set having four shoes 702 spaced equally apart around the circumference of second barrel portion 202B. Each shoe 702 is attached to two cylindrical pistons 704, discussed in detail hereinafter, via threaded pins 706. Each window 302 houses a single cylindrical piston 704 for radial in-and-out movement thereof. The inward movement of pistons 704 is limited by a stop provided by interior surfaces 708 of shoes 702 abutting exterior surface 710 of barrel 202 and the outward movement of pistons 704 is limited by a stop provided by lips 712 abutting shoulders 714 of pistons 704.

Referring now to FIG. 12, there is shown a cross section of barrel anchor means 208 taken on line 12—12 of FIG. 3C showing shoes 702 and pistons 704 connected therewith via pins 706 in an extended position for anchoring barrel 202 to surrounding earth bore 715 (FIG. 3C). Still referring to FIG. 12, each piston 704 includes a cylindrical solid body 724 having an annular recess 726, a resilient portion 728 covering and bondingly attached to the cylindrical surface and the interior end 730 of body 724, and a piston sleeve 732 received over the cylindrical surface of resilient porton 728. Piston sleeve 732 includes an annular internal flange 734 extending into recess 726 to prevent body 724 from blowing out of piston sleeve 732 and window 302 under pressure and an outwardly projection 736 forming shoulder 714. Piston sleeve 732 including flange 734 is bondingly attached to resilient portion 728. Resilient portion 728 is used to allow rocking of solid body 724 with respect to piston sleeve 732 and barrel 202. Resilient portion 728 should be preferably made out of rubber. Sealing engagement between pistons 704 and windows 302 is provided by lip seals 738.

Still referring to FIG. 12, solid body 724 is shown as one piece. However, it should be understood that, for assembly purposes, solid body 724 might consist of more than one continuous piece. For example, in one arrangement facilitating the assembly of piston 704, solid body 724 might consist of one tubular member that includes portion 724A, adjacent shoe 702, and a reduced diameter portion 724B and another tubular member 724C that might be connected to portion 724B by a threaded connection (not shown).

Referring now again to FIG. 3C, each shoe 702 is also connected to a rubber band 716 via pin 718. Rubber band 716 is received over pin 718 on one end and over pin 722 on the other end. Pin 722 is attached to barrel 202 at the bottom of socket 300. Each socket 300 houses a single rubber band 716. When piston 704 and shoe 702 move radially outwards, rubber band 716 is stretched with the end received over pin 722 remaining stationary, thereby biasing piston 704 and shoe 702 to an opposite direction, towards mandrel 200.

Referring now to FIG. 13, there is shown a cross section of barrel anchor means 208 taken on line 13—13 of FIG. 3C showing shoes 702 connected to rubber bands 716 via pins 718. Shoes 702 include tongues 740 having aligned bores 742 for receiving pins 718. Barrel 202 has aligned bores 744 for receiving pins 722. Rubber bands 716 are received over pins 718 on one end and over pins 722 on the other end. Still referring to FIG. 13, shoes 702 are shown in an extended position and therefore, rubber bands 716 are shown in a stretched position biasing shoes 702 towards barrel 202.

Referring now to FIG. 3A, inner mandrel anchor means 210 includes a set of four shoes 802 spaced equally apart around the circumference of second sub portion 204B. Each shoe 802 is attached to two cylindrical pistons 804 via threaded pins 806. Each window 350 houses a single cylindrical piston 804 for radial in-and-out movement thereof. The inward movement of piston 804 is limited by a stop provided by interior surface 808 of shoe 802 abutting exterior surface 810 of sub 204 and the outward movement of piston 804 is limited by a stop provided by lip 812 abutting shoulder 814 of piston 804.

Referring now to FIG. 10, there is shown a cross section of inner mandrel anchor means 210 taken on line 10—10 of FIG. 3A showing shoes 802 and pistons 804 connected therewith via pins 806, in a retracted position. Each piston 804 includes a cylindrical solid body 824 having an annular recess 826, a resilient portion 828 covering and bondingly attached to the cylindrical surface and the interior end 830 of body 824, and a piston sleeve 832 received over the cylindrical surface of resilient portion 828. Piston sleeve 832 includes an annular internal flange 834 extending into recess 826 to prevent body 824 from blowing out of piston sleeve 832 and window 350 and an outwardly projection 836 forming shoulder 814. Piston sleeve 832 including flange 834 is bondingly attached to resilient port 828. Resilient portion 828 is used to allow rocking of solid body 824 with respect to piston sleeve 832 and mandrel 200. Resilient portion 828 should be preferably made out of rubber. Sealing engagement between piston 804 and windows 350 is provided by lip seals 838.

Still referring to FIG. 10, solid body 824 is shown as one piece. However, it should be understood that, for assembly purposes, solid body 824 might consist of more than one continuous piece. For example, in one arrangement facilitating the assembly of piston 804, solid body 824 might consist of one tubular member that includes portion 824A, adjacent shoe 802, and reduced diameter portion 824B and another tubular member 824C that might be connected to portion 824B by a threaded connection (not shown).

Referring now again to FIG. 3A, each shoe 302 is also connected to a rubber band 816 via pin 818. Rubber band 816 is received over pin 818 on one end and over pin 822 on the other end. Pin 822 is attached to sub 204 at the bottom of socket 348. Each socket 348 houses a single rubber band 816. When piston 804 and shoe 802 move radially outwards, rubber band 816 is stretched with the end received over pin 822 remaining stationary, thereby biasing piston 804 and shoe 802 inwards, towards mandrel 200.

Referring now to FIG. 11, there is shown a cross section of mandrel anchor means 210 taken on line 11—11 of FIG. 3A showing shoes 802 connected to rubber bands 816 via pins 818. Shoes 802 include tongues 840 having aligned bores 842 for receiving pins 818. Sub 204 has aligned bores 844 for receiving pins 822. Rubber bands 816 are received over pins 818 on one end and over pins 822 on the other end.

Referring now to FIG. 14, there is shown a cross section of mandrel anchor means 210 taken on line 14—14 of FIG. 11 showing sub 204 having bores 844 for housing pin 822. Rubber band 816 is received around pin 822 in socket 348.

Referring now to FIG. 15 there is shown a cross section of mandrel anchor means 210 taken on line 15—15 of FIG. 11 showing tongues 840 having bores 842 for housing pin 818. Rubber band 816 is received around pin 818 in socket 348 of sub 204.

It should be understood that the construction of barrel anchor means 208 is similar to the construction of mandrel anchor means 210. More particularly, the construction of shoes 702, pistons 704, rubber bands 716 and their accessories may be identical to the construction of shoes 802, pistons 804, rubber bands 816 and their accessories, respectively. Therefore, it is not necessary to show details of barrel anchor means 208 in a retracted position or details of mandrel anchor means 210 in an extended position because the description of mandrel anchor means 210 in a retracted position and the described of barrel anchor means 208 hereinabove should enable one skilled in the art to practice the invention wherein barrel anchor means 208 are in a retracted position and mandrel anchor means 210 are in an extended position.

Referring now again to FIGS. 3A–D and following the description of the various components of the apparatus of the present invention hereinabove, the operation of the apparatus including the thrusting stage will become apparent. In the assembled form, barrel 202 and valve means 206, connected as described hereinabove, are received over inner mandrel 200. Sub 204 is also received over mandrel 200 and connected therewith as previously described. Furthermore, first sub portion 204A is partially received over fifth barrel portion 202E.

Referring now to FIGS. 5, 6 and 7 there are shown cross sections of automatic hydraulic thruster 190 showing the coaxial superposition of barrel 202 and valve means 206 over mandrel 200. FIG. 5 for the cross section taken on line 5—5 of FIG. 3B shows valve housing 374 having central bore 386 and diametrically opposite axial bores 388, 588 and being superpositioned over mandrel 200 and more particularly over third mandrel portion 200C having flowbore 231. Bore 388 houses ball 400 and is in fluid communication with bore 386 via radial port 390. Bore 588 houses displacing rod 422 and is in fluid communication with exterior cylindrical surfaces 392 of valve housing 374 via radial port 394. Annular conduit 500, hereinafter described, is formed between valve housing 374 and third mandrel portion 200C.

FIG. 6 for the cross section taken on line 6—6 of FIG. 3B shows valve sleeve 380 and third barrel portion 202C received over third mandrel portion 200C forming an annular conduit 500, hereinafter described, between valve sleeve 380 and third mandrel portion 200C. Snapping coil springs 468 of intake valve thrust actuation means 382 (not shown) and snapping coil spring 768 of exhaust valve thrust actuation means 384 (not shown) are disposed in first thrusting chamber portion 600A, hereinafter described.

FIG. 7 for the cross section taken on line 7—7 of FIG. 3B shows valve 380 and third barrel portion 202C received over third mandrel portion 200C forming annular conduit 500, hereinafter described, between valve sleeve 380 and third mandrel portion 200C. Marine bearing 446 is disposed in annular conduit 500. Valve actuation sleeve 470 is disposed over valve sleeve 380 in first thrusting chamber portion 600A, hereinafter described, and is prevented from rotating relative to valve sleeves 380 by keys 494 integrally attached thereto and disposed in keyways 496.

Referring now again to FIGS. 3A–D, rotational and axial movement of inner mandrel 200 with respect to barrel 202 and valve means 206 is facilitated by marine bearing 214, between first barrel portion 202A and first mandrel portion 200A, marine bearings 310, 312 and 314, between second barrel portion 202B and second mandrel portion 200B, marine bearings 246, between third barrel portion 202C and coupling 238, marine bearings 446, 646, between valve means 206 and third mandrel portion 200C. Rotational movement of inner mandrel 200 with respect to sub 204 is facilitated by marine bearings 355, 356, between second sub portion 204B and third mandrel portion 200C, and ball bearing 264, between third subportion 204C and fourth mandrel portion 200D. Rotational and axial movement of sub 204 with respect to barrel 202 is facilitated by marine bearing 330, between first subportion 204A and fifth barrel porton 200E.

Referring now to FIG. 8, there is shown a cross section of marine bearing 246 taken on line 8—8 of FIG. 3C. Marine bearing 246 includes a resilient element, preferably rubber, being bonded to coupling 238 and having a fluted convolution of surface 894 between marine bearing 246 and third mandrel portion 202C. Marine bearings 214 and 330 are similar to marine bearings 246. Referring now to FIG. 9, there is shown a cross section of marine bearing 314 taken on line 9—9 of FIG. 3C in which the resilient element is carried by the exterior member, in this case second barrel portion 202B, and has a fluted convolution of surface 896 between marine bearing 314 and second mandrel portion 200B. Marine bearings 310, 312, 446, 646, 355 and 356 are similar to marine bearing 314. Marine bearings such as the ones shown in FIGS. 8 and 9 permit circulation of fluids intermediate the sliding surfaces and yet provide a firm but resilient bearing surface.

Referring now again to FIGS. 3A–D, the coaxial superposition of barrel 202 and valve means 206 over mandrel 200 and the coaxial superposition of sub 204 over mandrel 200 and over a portion of barrel 202 results in the formation of an annular conduit 500, an annular thrusting chamber 600 and an annular resetting chamber 700. Annular conduit 500 is formed between third mandrel portion 200C and valve sleeve 380, valve housing 374 and valve sleeve 580 and is sealed, in one end, by swivel packing means 450 between valve sleeve 380 and third mandrel portion 200C and, in the other end, by swivel packing means 650 between valve sleeve 580 and third mandrel portion 200C. Annular conduit 500 is in fluid communication with port 390 and port 252.

Annular thrusting chamber 600 includes a first thrusting chamber portion 600A between valve sleeve 380 and third barrel portion 202C, a second thrusting chamber portion 600B between third mandrel portion 200C and third barrel portion 202C, a third thrusting chamber portion 600C between coupling 238 and third barrel portion 202C, a fourth thrusting chamber portion 600D between second mandrel portion 200B and third barrel portion 202C, a fifth thrusting chamber portion 600E between second mandrel portion 200B and second barrel portion 202B, including interior portion 302A of windows 302 between second mandrel portion 200B and pistons 704, a sixth thrusting chamber portion 600F between second mandrel portion 200B and first barrel portion 202A and a seventh thrusting chamber portion 600G between first mandrel portion 200A and first barrel portion 202A. All thrusting chamber portions 600A–G are in continuous fluid communication therebetween, and such fluid communication is not interrupted by the marine bearings 310, 312, 314 and 246 due to the presence of flutes in the exterior or interior surfaces thereof, previously described by reference to FIGS. 8 and 9. Thrusting chamber 600 is in fluid communication with bores 388 and 588 only and any other fluid communication thereof with exterior 502 of the apparatus or with flowbore 231 of mandrel 200 is sealed by swivel type packing 218, between first mandrel portion 200A and first barrel portion 202A, lip seals 738, between pistons 704 and windows 302 and swivel packing means 450 between valve sleeve 380 and third mandrel portion 200C.

Annular resetting chamber 700 includes a first resetting chamber portion 700A between valve sleeve 580 and fourth barrel portion 202D, a second resetting chamber portion 700B between third mandrel portion 200C and fourth barrel portion 202D, a third resetting chamber portion 700C between third mandrel portion 200C and fifth barrel portion 202E, a fourth resetting chamber portion 700B between third mandrel portion 200C and first sub portion 204A, a fifth resetting chamber portion 700E between third mandrel portion 200C and second sub portion 204B, including interior portions 350A of windows 350 between third mandrel portion 200C and pistons 804, a sixth resetting chamber portion 700F between third mandrel portion 200D and third sub portion 204C and a seventh resetting chamber portion 700G between fourth mandrel portion 200D and third subportion 204C. All resetting chamber portions 700A–G are in continuous fluid communication therebetween and such fluid communication is not interrupted by marine bearings 355 and 356 due to the presence of flutes on the interior surface thereof, previously described by referring to FIG. 9. Resetting chamber 700 is in fluid communication with bores 388 and 588 only, and any other fluid communication thereof with exterior 502 of the apparatus or with flowbore 231 of mandrel 200 is sealed by swivel type packing 274, between fourth mandrel portion 200D and third sub portion 204C, lip seals 838, between pistons 804 and windows 350, swivel packing means 334, between fifth barrel portion 202E and first subportion 204A, and swivel packing means 650, between valve sleeve 580 and third mandrel portion 200C.

Referring still to FIGS. 3A–D, as previously stated, there is shown automatic hydraulic thruster 190 in a thrusting position. In general, in that position, barrel 202 is anchored to earth bore 715 via barrel anchor means 208, expanded against bore 715 in a manner hereinafter described, to prevent axial and rotational movement thereof. Drill string 230 rotation by a conventional rotary drilling machine (not shown) causes the rotation of mandrel 200 and the drill bit. At the same time, thrusting force exerted on the drill bit by automatic hydraulic thruster 190 via mandrel 200, in a manner hereinafter described, combined with the rotation thereof enables the drill bit to bore the earth and to advance therein.

Describing now in more detail the thrusting operation and still referring to FIGS. 3A–D, it should be understood that during the drilling operation including both thrusting and resetting modes, hereinafter described, the fluid pressure in flowbore 231 is maintained at a level higher than that of the fluid pressure in exterior 502 of thruster 190 by conventional pumping means (not shown). In the thrusting position, ball 400 rests on valve seat 602 and closes the fluid communication between resetting chamber 700 and port 390. Furthermore, ball 420 rests on valve seat 418 and ball displacing rod 422 displaces ball 620 away from valve seat 618 and immediately adjacent pin end 878 of elongated rod 862, whereby fluid communication between thrusting chamber 600 and port 394 via bore 588 is closed and fluid communication between resetting chamber 700 and port 394 via bore 588 is opened. Therefore, thrusting chamber 600 is exposed to the high pressure fluid of flowbore 231 via port 252, annular conduit 500, port 390 and bore 388, whereas, resetting chamber 700 is exposed to the low pressure fluid of exterior 502 of the apparatus via port 394 and bore 588.

The pressure differential between thrusting chamber 600 and resetting chamber 700 causes balls 400 and 420 to remain resting on valve seats 602 and 418, respectively, until they are mechanically displaced therefrom in a manner hereinafter described at the end of the thrusting operation. Furthermore, the same pressure differential causes pistons 704 of barrel anchor means 208 to move outwards and shoes 702 to engage surrounding earth bore 715, thereby preventing axial and rotational movement of barrel 202. Furthermore, the same pressure differential exerts an axial force on annular surface between swivel packing means 218 and swivel packing means 450. The axial force is transmitted to the drill bit connected thereto to provide the necessary thrusting force for boring the earth. As the drill bit rotationally bores the earth and advances therein, mandrel 200 and sub 204 simultaneously advance therewith, while barrel 202 and valve means 206 remain stationary. When mandrel 200 advances to a certain point relative to stationary valve means 206, valve actuator 250 abuts extension member 671 of valve actuation sleeve 670. Further advancement of mandrel 200 causes valve actuation sleeve 670 and adjacent pins 666, 866 to advance also, causing the compression of snapping springs 668, 868, thereby gradually increasing the restoring forces thereof. Retracting springs 664 and 864 are not compressed because elongated rods 662 and 862 remain stationary by abutting balls 400 and 620, respectively. The restoring forces of snapping springs 668, 868 are applied on balls 400, 420, respectively, in an opposite direction to the forces applied on balls 400, 420 by the pressure differential between thrusting chamber 600 and resetting chamber 700.

When the restoring force of either snapping spring 668 or 868 exceeds the hydraulic force acting against it, the ball on which such force is exerted on will be displaced from its valve seat. Such displacement will result in the reduction of the pressure differential between thrusting chamber 600 and resetting chamber 700, whereby the restoring force of the other snapping spring 868 or 668 will exceed the hydraulic force acting against it and will displace the ball on which such force is exerted on from its valve seat. More particularly, if the restoring force of snapping spring 668 being exerted in ball 400 is the first restoring force to exceed its counteracting hydraulic force, ball 400 is displaced from valve seat 602, whereby the pressure around it is equalized. This allows the restoring force of snapping spring 668 to force ball 400 by a quick action to move to a resting position on valve seat 402, thereby closing the fluid communication between thrusting chamber 600 and port 390 and opening the fluid communication between resetting chamber 700 and port 390. At the same time, the reduction of the pressure differential between thrusting chamber 600 and resetting chamber 700, due to the exposure of resetting chamber 700 to high pressure fluid from flowbore 231, allows snapping spring 868 to displace ball 420 via ball 620 and displacing rod 422 from valve seat 418 and to force ball 620 by a quick action to move to a resting position on valve seat 618.

On the other hand, if the restoring force of snapping spring 868 being exerted on ball 420 via ball 620 and displacing rod 422 is the first restoring force to exceed its counteracting hydraulic force, ball 420 is displaced from valve seat 418, whereby the pressure around ball 420, displacing rod 422 and ball 620 is equalized. This allows the restoring force of snapping ring 868 to force ball 620 by a quick action to move to a resting position on valve seat 618, thereby opening fluid communication between thrusting chamber 600 and port 394 via bore 588 and closing fluid communication between resetting chamber 700 and port 394. At the same time, the reduction of the pressure differential between thrusting chamber 600 and resetting chamber 700, immediately following the displacement of ball 420 from valve seat 418, allows snapping spring 668 to displace ball 400 from valve seat 602 and to force ball 400 by a quick action to move to a resting position on valve seat 402, thereby closing the fluid communication between thrusting chamber 600 and port 390 and opening the fluid communication between resetting chamber 700 and port 390 via bore 388.

It is possible under certain conditions for snapping coil spring 668 or snapping coil spring 868 to fully compress or go solid before the restoring force of either spring 668 or 868 exceeds its counteracting hydraulic force. In that case, immediately following the full compression of the particular spring, the ball on which such spring exerts its restoring force is displaced from its seat, resulting in a sequence of events identical to those described above following the initial displacement of one ball by the restoring force of a snapping spring.

All the aforementioned operational sequences concerning the relocation of ball 400 from valve seat 602 to valve seat 402 and the displacement of ball 420 from valve seat 418 coupled with the placement of ball 620 on valve seat 618 have the same ultimate result, namely, the transformation of thrusting chamber 600 from a high pressure to a low pressure chamber by exposing it to low pressure fluid from exterior 502 of thruster 190 and the transformation of resetting chamber 700 from a low pressure to a high pressure chamber by exposing it to high pressure fluid from flowbore 231 of mandrel 200 to commence the resetting operation.

Referring now to FIGS. 4A–D, there is shown automatic hydraulic thruster 190 in a resetting position. The pressure equalization between thrusting chamber 600 and exterior 502 together with the retracting biasing force exerted by rubber bands 716 on shoes 702, cause pistons 704 and shoes 702 to move radially inwards and to disengage barrel anchoring means 208 from earth bore 715 whereby barrel 202 may move axially therein. At the same time, the high pressure is resetting chamber 700 causes pistons 804 of mandrel anchor means 210 to move outwards and shoes 802 to engage surrounding earth bore 715, thereby preventing axial movement of mandrel 200 and sub 204 and rotational movement of sub 204. Furthermore, the pressure differential between resetting chamber 700 and thrusting chamber 600 exerts an axial force on annular surface between packing means 334 and packing means 650, causing barrel 202 and valve means 206 to move axially towards the drill bit while mandrel 200 and sub 204 remain stationary. When barrel 202 and valve means 206 advance to a certain point relative to stationary mandrel 200, coupling 238 abuts end 717 of valve actuation sleeve 470. Further advancement of barrel 202 and valve means 206 combined with the inability of valve actuation sleeve 470 to advance therewith, causes the compression of snapping coil springs 468 and 768, thereby gradually increasing the restoring forces thereof. Retracting springs 464 and 764 are not compressed because elongated rods 462 and 762 remain stationary by abutting balls 400 and 420, respectively. The restoring forces of snapping springs 468, 768 are applied on balls 400, 620, respectively, in an opposite direction to the forces applied on balls 400, 620 by the pressure differential between resetting chamber 700 and thrusting chamber 600. When the restoring force of either snapping spring 468 or 768 exceeds the hydraulic force acting against it, the ball on which such force is exerted on will be displaced from its valve seat. Such displacement will result in the reduction of the pressure differential between resetting chamber 700 and thrusting chamber 600, whereby the restoring forces of the other snapping spring 768 or 468 will exceed the hydraulic force acting against it and will displace the ball on which such force is exerted on from its valve seat.

More particularly, if the restoring force of snapping spring 468 being exerted on ball 400 is the first restoring force to exceed its counteracting hydraulic force, ball 400 is displaced from valve seat 402, whereby the pressure around it is equalized. This allows the restoring force of snapping spring 468 to force ball 400 by a quick action to move to a resting position on valve seat 602, whereby closing the fluid communication between resetting chamber 700 and port 390 and opening the fluid communication between thrusting chamber 600 and port 390. At the same time, the reduction of the pressure differential between resetting chamber 700 and thrusting chamber 600 due to the exposure of thrusting chamber 600 to high pressure fluid from flowbore 231, allows snapping spring 768 to displace ball 620 via ball 420 and displacing rod 422 from valve seat 618 and to force ball 420 by a quick action to move to a resting position on valve seat 418. Therefore fluid communication between resetting chamber 700 and port 394 via bore 588 is opened, whereas fluid communication between thrusting chamber 600 and port 394 is closed. On the other hand, if the restoring force of snapping spring 768 being exerted on ball 620 via ball 420 and displacing rod 422 is the first restoring force to exceed its counteracting hydraulic force, ball 620 is displaced from valve seat 618, whereby the pressure around ball 620, displacing rod 422 and ball 420 is equalized. This allows the restoring force of snapping ring 768 to force ball 420 by a quick action to move to a resting position on valve seat 418, thereby opening fluid communication between resetting chamber 700 and port 394 via bore 588 and closing fluid communication between thrusting chamber 600 and port 394. At the same time, the reduction of the pressure differential between resetting chamber 700 and thrusting chamber 600, immediately following the displacement of ball 620 from valve seat 618, allows snapping spring 468 to displace ball 400 from valve seat 402 and to force ball 400 by a quick action to move to a resting position on valve seat 602, thereby closing the fluid communication between resetting chamber 700 and port 390 and opening the fluid communication between thrusting chamber 600 and port 390 via bore 388.

Similarly to the thrusting operation, it is possible under certain conditions for snapping coil spring 468 or snapping coil spring 768 to fully compress or go solid before the restoring force of either spring 468 or 768 exceeds its counteracting hydraulic force. In that case, immediately following the full compression of the particular spring, the ball on which such spring exerts its restoring force is displaced from its seat, resulting in a sequence of events identical to those described above following the initial displacement of one ball by the restoring force of a snapping spring during the resetting operation.

All the aforementioned operational sequences concerning the relocation of ball 400 from valve seat 402 to valve seat 602 and the displacement of ball 620 from valve seat 618 coupled with the placement of ball 420 on valve seat 418 have the same ultimate result, namely, the transformation of resetting chamber 700 from a high pressure to a low pressure chamber by exposing it to low pressure fluid from exterior 502 of thruster 190 and the transformation of thrusting chamber 600 from a low pressure to a high pressure chamber by exposing it to high pressure fluid from flowbore 231 of mandrel 200 to commence the thrusting operation, described hereinabove.

Referring now again to FIGS. 3A–D, it is apparent that, at the end of the thrusting operation, the restoring forces of snapping coil springs 668, 868 would force elongated rods 662, 862, respectively, to move rapidly with balls 400, 620 and to remain adjacent balls 400, 620 when such balls come to rest on valve seats 402, 618, respectively, thereby preventing the displacement of such balls from their seats at the end of the resetting operation. In order to prevent such difficulty, retracting coil springs 664, 864 are provided to move elongated rods 662, 862, respectively, by applying their restoring forces on flanges 672, 872, respectively, when axial movement of valve means 206 away from flange 250 during the resetting operation allows it. Similarly, retracting coil springs 464, 764 are provided to retract elongated rods 462, 762, respectively, when axial movement of coupling 238 away from valve means 206 during the thrusting operation allows it.

It should be understood that the cross sectional area of annular surface between packing means 218 and packing means 450 on which the pressure differential between thrusting chamber 600 and exterior 502 of automatic hydraulic thruster 190 applies the axial thrusting force is substantially larger than the combined area of the cross sections of ball 400 and ball 420 on which the same pressure differential applies an opposite axial force. This is to ensure the forward or axial movement of mandrel 200 towards the closed end of the borehole being drilled during the thrusting operation until the position of balls 400, 420 and 620 is changed, as previously described, to terminate the thrusting operation and to commence the resetting operation.

Similarly, it should be understood that the cross sectional area of annular surface between packing means 334 and packing means 650, on which the pressure differential between resetting chamber 700 and thrusting chamber 600 applies the axial force responsible for moving barrel 202 and valve means 206 axially relative to stationary mandrel 200 during the resetting operation, is substantially larger than the combined area of the cross sections of ball 400 and ball 620 on which the same pressure differential applies an opposite axial force, to ensure the forward or axial movement of barrel 202 and valve means 206 towards the closed end of the borehole during the resetting operation until the position of balls 400, 420 and 620 is changed as previously described to terminate the resetting operation and to commence the thrusting operation.

It should also be understood that the retracting force exerted by rubber bands 716 on shoes 702 when shoes 702 are anchored to the surrounding earth borehole during the thrusting operation is substantially lower than the force exerted by the pressure differential between thrusting chamber 600 and exterior 502 of thruster 190 on pistons 704 to prevent premature retraction of barrel anchor means 208. Similarly, it should be also understood that the retracting force exerted by rubber bands 816 on shoes 802 when shoes 802 are anchored to the surrounding earth borehole during the resetting operation is substantially lower than the force exerted by the pressure differential between resetting chamber 700 and exterior 502 of thruster 190 on pistons 804 to prevent premature retraction of mandrel anchor means 210.

Referring now to FIG. 16 there is shown an alternative embodiment of intake valve thrust actuation means 382 and exhaust valve thrust actuation means 384 shown in FIGS. 3A–D together with only a portion of automatic hydraulic thruster 190 that is necessary to clearly show the alternative embodiment of such means. The elements of automatic hydraulic thruster 190 that have been previously described and shown in FIG. 16 are mandrel 200, barrel 202, valve sleeve 380 disposed about mandrel 200 having marine bearing 446 and swivel packing means 450 therebetween, and keyways 496 on its exterior cylindrical surface, retracting coil springs 464, 764 and flanges 486, 786. Furthermore, it should be noted that elongated rods 462', 762' are similar to the previously described elongated rods 462, 762 except that elongated rods 462', 762' do not have short portion 476, 776 of elongated rods 462, 762 but only flanges 472, 772 and long portions 474, 774 of elongated rods 462, 762. Furthermore, it should be noted that there is shown in FIG. 16 a flange or valve actuator 238' replacing for simplicity purposes coupling 238 of FIG. 3C that was shown hereinabove as the valve actuator for the thrusting operation. The aforementioned elements are shown in a general schematic form without details for simplicity purposes and one should refer to FIGS. 3A–D for details.

Referring now to the elements of this embodiment, pins 466, 766, snapping spring 468, 768 and valve actuator sleeve 470 of intake valve thrust actuator means 382 and exhaust valve thrust actuator means 384 have been replaced by sleeve 902, valve actuation cap 904, snapping coil spring 906 and trigger 908.

Sleeve 902 is a tubular member having an exterior flange 910 on one end 912 and an interior axial tapered groove 914 tapering gradually from adjacent end 912 and extending over a substantial portion of the length of sleeve 902.

Valve actuation cap 904 is a tubular member having an annular chamber 916 being closed in one end 918 and open on the other end 920 thereby forming an exterior annular end portion 920A and an interior annular end portion 920B. Interior annular end portion 920B projects axially beyond exterior end portion 920A and forms a tapered projection 922. Furthermore, valve actuation cap 904 includes an internal flange 924 on end 918.

Snapping coil spring 906 is a spring adapted to be received over the exterior cylindrical surface of sleeve 902 and to extend over a substantial portion of such surface. Trigger 908 is a leaf spring having a tapered end 926, a thin end 928 and a shoulder 930.

In the assembled position, trigger 908 is attached by end 928 to the interior cylindrical surface of sleeve 902 and extends axially in parallel therewith over the entire length of tapered groove 914. Trigger 908 is adapted to stay outside tapered groove 914 when it is in a free or unbiased position and to move into tapered groove 914 when biased by a force exerted on tapered end 926. Sleeve 902 is received over valve sleeve 380 until flange 910 abuts flanges 472, 772 of elongated rods 462', 762' and shoulder 930 abuts the annular end of valve sleeve 380, thereby preventing any further axial movement of sleeve 902 towards elongated rods 462', 762'. Valve actuation cap 904 is disposed about mandrel 200 and slidingly receives sleeve 902 in annular chamber 916 through open end 920. Keys 940 rigidly attached to sleeve 902 and adapted to slide in axial keyways 942 present in the interior of annular chamber 916 allow a predetermined axial movement but prevent any rotational movement of valve actuation cap 904 with respect to sleeve 902. Snapping coil spring 906 received over sleeve 902 abuts flange 910 on one end 944 and exterior annular end 920A on the other end 946.

Referring now to FIG. 17, there are shown cross section of the embodiment on line 17—17 of FIG. 16 to clearly show the assembly of the apparatus. There is shown barrel 202, mandrel 200, valve actuation cap 904 disposed over mandrel 200, sleeve 902 disposed over mandrel 200 and being partially received in annular chamber 916. Sleeve 902 has key 940 adopted to fit in keyways 942 in annular chamber 916. Trigger 908 is adapted to stay outside tapered groove 914 when it is in a free or unbiased position.

Referring now again to FIGS. 4A–D and 16, in the resetting operation, previously described, barrel 202 and valve means 206 including valve sleeve 380 advance axially while mandrel 200 remains stationary. Similarly, in the embodiment of FIG. 16 barrel 202 and valve sleeve 380 advance axially towards valve actuator 238'. When end 918 reaches valve actuator 238' and flange 924 abuts valve actuator 238', the advancement of valve actuation cap 904 is inhibited whereas sleeve 902 carried by valve sleeve 380 continues to advance into annular chamber 916, thereby causing the compression of snapping coil spring 906 and the gradual increase of the restoring force thereof with end 946 being the fixed end and end 944 being the moving end of spring 906. When tapered end 926 of trigger 908 reaches correspondingly tapered projection 922, trigger 908 is pushed into groove 914, thereby releasing sleeve 902 from valve sleeve 380 and allowing sleeve 902 to push with great force that has been accumulated in compressed snapping spring 906 elongated rods 462', 762'. In turn, elongated rod 462' being pushed by sleeve 902 displaces ball 400 from valve seat 402 and pushes it by quick action on valve seat 602, as previously described. At the same time, elongated rod 762' displaces ball 620 away from valve seat 618 via ball 420 and displacing rod 422 and pushes ball 420 on valve seat 418. In this manner, as previously explained, thrusting chamber 600 is exposed to the high pressure fluid of flowbore 231 of mandrel 200 and resetting chamber 700 is exposed to the low pressure fluid of exterior 502 of thruster 190 to commence the thrusting operation.

It should be understood that an apparatus similar to the apparatus shown in FIG. 16 may be used as an alternative embodiment of valve intake reset actuation means 582 and exhaust valve reset actuation means 584. In view of the fact that such embodiment would be substantially similar in construction and in operation to the one described in FIG. 16, such a description is not provided herein to avoid repetition.

The embodiment shown in FIG. 16 enables one to preset the restoring force desired for displacing balls 400, 620 from valve seats 402, 618, respectively, and for pushing balls 400, 420, by a quick action, on valve seats 602, 418, respectively.

While a preferred embodiment of the invention has been shown and described, modifications thereof can be made by one skilled in the art without departing from the spirit of the invention.

I claim:

1. Automatic hydraulic thruster comprising a tubular mandrel having hither and farther ends adapted respectively for connection to hither and farther drill string components, the hither component to extend in from a hole bore entrance and the farther component to be connected to a drill bit;

a sleeve concentrically disposed about the mandrel for rotation and axial motion of the mandrel within the sleeve and axial motion of the sleeve relative to the mandrel;

annular piston means carried by the mandrel sealingly engaging the interior of the sleeve and dividing the annulus between the mandrel and sleeve into first and second chambers adjacent the hither and farther ends of the sleeve;

means sealing between the mandrel and sleeve at diameters smaller than that of said piston closing the ends of said chambers farthest from said piston;

wall anchor means carried by the sleeve responsive to pressure differential between the first chamber and the ambient outside the thruster to move outwardly to engage a hole bore when the first chamber pressure is hgher than said ambient and to relax from such engagement upon equalization of the pressure in the first chamber and said ambient;

first three way valve means having an inlet and two outlets, its inlet connected to the mandrel and its two outlets connected respectively to said first and second chambers, said first three-way valve means including first actuator means responsive to the relative axial positions of said mandrel and sleeve for opening said inlet to one or the other of said outlets and closing it to said other or said one as said mandrel and sleeve reach extremes of their relative axial motions;

second three way valve means having an outlet and two inlets with its outlet connected to the ambient outside the thruster and its two inlets connected respectively to said first and second chambers, said second three way valve means including second actuator means responsive to the relative axial positions of said mandrel and sleeve for opening said outlet to one or the other of said inlets and closing it to said other or said one of said inlets as said mandrel and sleeve reach extremes of their relative axial motions;

said first and second actuator means cooperating to pressurize the first chamber and depressurize the second chamber at one of said extremes and to depressurize the first chamber and pressurize the second chamber at the other of said extremes;

said wall anchor means serving to anchor said sleeve to a hole wall when the first chamber is pressurized and at the same time said piston means exerting a thrust on said mandrel directed from the hither to the farther end of the thruster;

said wall anchor means releasing said sleeve for relative axial motion along the hole wall when the first chamber is depressurized and at the same time pressurization of the second chamber exerting a force to move said said sleeve axially away from the hither end of the thruster toward the farther end thereof.

2. Automatic hydraulic thruster comprising a tubular mandrel member having hither and farther ends adapted respectively for connection to hither and farther drill string components, the hither component to extend in from a hole bore entrance and the farther component to be connected to a drill bit;

a sleeve member concentrically disposed about the mandrel member for rotation and axial motion of the mandrel member within the sleeve member and axial motion of the sleeve member relative to the mandrel member;

annular divider means carried by one of the members sealingly engaging the adjacent periphery of the other of the members and dividing the annulus between the mandrel and sleeve members into first and second chambers adjacent the hither and farther ends of the sleeve;

end means sealing between said members at diameters which differ from that where said divider means engages sealingly said one member closing the ends of said chambers farthest from said divider means;

wall anchor means carried by the sleeve member responsive to pressure differential between the first chamber and the ambient outside the thruster to move outwardly to engage a hole bore when the first chamber pressure is higher than said ambient and to relax from such engagement upon equalization of the pressure in the first chamber and said ambient;

first three way valve means having an inlet and two outlets, its inlet connected to the mandrel member and its two outlets connected respectively to said first and second chambers, said first three way valve means including first actuator means responsive to the relative axial positions of said mandrel and sleeve members for opening said inlet to one or the other of said outlets and closing it to said other or said one as said mandrel and sleeve reach extremes of their relative axial motions;

second three way valve means having an outlet and two inlets with its outlet connected to the ambient outside the thruster and its two inlets connected respectively to said first and second chambers, said second three way valve means including second actuator means responsive to the relative axial positions of said mandrel and sleeve members for opening said outlet to one or the other of said inlets and closing it to said other or said one of said inlets as said mandrel and sleeve members reach extremes of their relative axial motions;

said first and second actuator means cooperating to pressurize the first chamber and depressurize the second chamber at one of said extremes and to depressurize the first chamber and pressurize the second chamber at the other of said extremes;

said wall anchor means serving to anchor said sleeve member to a hole wall when the first chamber is pressurized and at the same time one of said end or divider means exerting a thrust on said mandrel directed from the hither to the farther end of the thruster;

said wall anchor means releasing said sleeve for relative axial motion along the hole wall when the first chamber is depressurized and at the same time pressurization of the second chamber exerting a force to move said said sleeve axially away from the hither end of the thruster toward the farther end thereof.

3. Automatic hydraulic thruster comprising a tubular mandrel having hither and farther ends adapted respectively for connection to hither and farther drill string components, the hither component to extend in from a hole bore entrance and the farther component to be connected to a drill bit;

a sleeve concentrically disposed about the mandrel for rotation and axial motion of the mandrel within the sleeve and axial motion of the sleeve relative to the mandrel;

annular valve means carried by the sleeve sealingly engaging the exterior of the mandrel and dividing the annulus between the mandrel and sleeve into first and second chambers adjacent the hither and farther ends of the sleeve;

means sealing between the mandrel and sleeve at diameters larger than that of said valve means where it engages said mandrel and closing the ends of said chambers farthest from said piston;

wall anchor means carried by the sleeve responsive to pressure differential between the first chamber and the ambient outside the thruster to move outwardly to engage a hole bore when the first chamber pressure is higher than said ambient and to relax from such engagement upon equalization of the pressure in the first chamber and said ambient;

first three way valve means having an inlet and two outlets, its inlet connected to the mandrel and its two outlets connected respectively to said first and second chambers, said first three way valve means including first actuator means responsive to the relative axial positions of said mandrel and sleeve for opening said inlet to one or the other of said outlets and closing it to said other or said one as said mandrel and sleeve reach extremes of their relative axial motions;

second three way valve means having an outlet and two inlets with its outlet connected to the ambient outside the thruster and its two inlets connected respectively to said first and second chambers, said second three way valve means including second actuator means responsive to the relative axial positions of said mandrel and sleeve for opening said outlet to one or the other or said inlets and closing it to said other of said one of said inlets as said mandrel and sleeve reach extremes of their relative axial motions;

said first and second actuator means cooperating to pressurize the first chamber and depressurize the second chamber at one of said extremes and to depressurize the first chamber and pressurize the second chamber at the other of said extremes;

said wall anchor means serving to anchor said sleeve to a hole wall when the first chamber is pressurized and at the same time said chamber's end exerting a thrust on said mandrel directed from the hither to the farther end of the thruster;

said wall anchor means releasing said sleeve for relative axial motion along the hole wall when the first chamber is depressurized and at the same time pressurization of the second chamber exerting a force to move said said sleeve axially away from the hither end of the thruster toward the farther end thereof.

4. An apparatus according to claim 2 wherein said wall anchor means comprises:

a piston disposed in an opening through said sleeve, said piston being adapted to move outwardly to engage the hole wall when the first chamber pressure is higher than said ambient and to relax from such engagement upon equalization of the pressure in the first chamber and said ambient;

a rubber band connected to said piston and said sleeve, said rubber band being adapted to stretch when said piston moves outwardly and to withdraw said piston to the sleeve upon equalization of the pressure in the first chamber and said ambient by exerting its resilient force on said piston; and means extending from said piston for providing a first stop to the outward movement of said piston and a second stop to the inward movement of said piston.

5. An apparatus according to claim 4 wherein said piston comprises:

a piston sleeve having a first flange extending towards the interior of said piston sleeve and a second flange extending towards the exterior of said piston sleeve, said second flange being adapted to abut an inward projection in the opening of said sleeve upon a predetermined outward movement of said piston sleeve;

a body being disposed in the interior of said piston sleeve, said body having a recess for housing said first flange to limit the outward and inward movement of said body with respect to said piston sleeve; and a resilient member being disposed between said body and said piston sleeve;

said resilient member allowing the rocking of said body with respect to said piston sleeve.

6. An apparatus according to claim 2 wherein said first actuator means comprises:

a first ball floatingly suspended between the two outlets, said first ball being movable to one or the other of said outlets for opening said inlet to said other or said one and closing said inlet to said one or said other;

a first rod being reciprocally disposed in the first chamber for displacing said first ball from said other outlet to said one outlet by exerting a pushing force on said first ball as said mandrel and sleeve reach extremes of their relative axial motions.

7. An apparatus according to claim 6 further including means for increasing and means for releasing the pushing force exerted on said first ball by said first rod.

8. An apparatus according to claim 7 wherein said force increasing and force releasing means includes:

a first spring being disposed in the first chamber and having one end in contact with said first rod; and means for compressing said spring against said first rod as said first rod remains stationary and as said mandrel and sleeve move axially with respect to each other.

9. An apparatus according to claim 7 wherein said force increasing and force releasing means includes:

a valve actuation sleeve being disposed in the first chamber and having one end in contact with said first rod;

a first spring being disposed in the first chamber and having one end in contact with said valve actuation sleeve;

means for compressing said first spring against said valve actuation sleeve to a direction biasing said valve actuation sleeve against said first rod as said mandrel and sleeve move axially with respect to each other;

means for retaining said valve actuation sleeve stationary while said first spring is being compressed and for preventing the restoring force of said first spring from being exerted on said first rod; and means for disengaging said retaining means and for exerting the restoring force of said first spring on said first rod upon a predetermined axial movement of said mandrel and sleeve with respect to each other.

10. An apparatus according to claim 6 further including means for retracting said first rod to a position in which said first rod would not obstruct the displacement of said first ball from said one outlet back to said other outlet.

11. An apparatus for anchoring the body of a hydraulic thruster to the wall of a hole bore, the body of the hydraulic thruster having a chamber being in fluid communication with a pressure source, comprising:

a piston sleeve disposed in an opening through the body, said piston sleeve having a first flange extending towards the interior of said piston sleeve and a second flange extending towards the exterior of said piston sleeve, said second flange being adapted to abut an inward projection in the opening of the body upon a predetermined outward movement of said piston sleeve;

a piston body being disposed in the interior of said piston sleeve, said piston body having a recess for housing said first flange to limit the outward and inward movement of said piston body with respect to said piston sleeve;

a piston head being attached to the exterior end of said piston sleeve;

a resilient member being disposed between said piston body and said piston sleeve;

said resilient member allowing the rocking of said piston body with respect to said piston sleeve; and said piston sleeve and said piston body being adapted to move outwardly so that the piston head engages the wall when the chamber pressure is higher than the pressure outside the body and to relax from such engagement upon equalization of the pressure in the chamber and outside the body.

12. An apparatus according to claim 11 further including means for providing a first stop to the outward movement of said piston sleeve and a second stop to the inward movement of said piston sleeve.

13. An apparatus according to claim 11 further including a rubber band connected to said piston head and said body, said rubber band being adopted to stretch when said piston head moves outwardly and to withdraw said piston head to the body upon equalization of the pressure in the chamber and outside the body by inverting its resilient force on said piston head.

14. A valve, comprising:

a body having a chamber and three ports providing fluid communication between the chamber and the exterior of said body;

a first ball floatingly suspended in said body, said first ball being movable to a first position in engagement with the first port for closing the first port and to a second position out of engagement with the first port for opening the first port;

a first rod slidingly attached to said body for a sliding movement towards and away from said first ball;

a first member being slidingly attached to said body, said first member being slidingly movable towards and away from said first rod;

a first spring being between said first rod and said first member, said first spring being compressed by said first member while said first member moves slidingly towards said first rod while said first rod closing the fourth port and to a second second ball position out of engagement with the fourth port for opening the fourth port;

a third ball floatingly suspended in said valve body, said third ball being movable to a first third ball position in engagement with the fifth port for closing the fifth port and to a second third ball position out of engagement with the fifth port for opening the fifth port;

a push rod floatingly positioned in the low pressure distribution chamber between said second and third balls, said push rod being movable towards said third ball to displace said third ball from the first third ball position to the second third ball position upon movement of said second ball from the second second ball position to the first second ball position, and said push rod being movable towards said second ball to displace said second ball from the first second ball position to the second second ball position upon movement of said third ball from the second third ball position to the first third ball position;

a first rod for displacing said first ball from the first first ball position to the second first ball position;

a second rod for displacing said first ball from the second first ball position to the first first ball position;

a third rod for displacing said second ball from the second second ball position to the first second ball position; and a fourth rod for displacing said third ball from the second third ball position to the first third ball position.

23. A valve according to claim 22 further including:

a first spring aligned with and attached to said first rod;

a second spring aligned with and attached to said second rod;

a third spring aligned with and attached to said third rod; and a fourth spring aligned with and attached to said fourth rod.

24. A valve according to claim 23 further including:

a first ring slidingly attached to said body, said first ring being slidingly movable to compress said first spring and said third spring simultaneously against said first rod and said third rod, respectively, while said first and said third rods remain stationary; and a second ring slidingly attached to said body, said second ring being slidingly movable to compress said second spring and said fourth spring simultaneously against said second rod and said fourth rod, respectively, while said second and said fourth rods remain stationary.

* * * * *

UNITED STATES PATENT AND TRADEMARK OFFICE

CERTIFICATE OF CORRECTION

PATENT NO. : 4,615,401

DATED : OCTOBER 7, 1986

INVENTOR(S) : WILLIAM R. GARRETT

It is certified that error appears in the above—identified patent and that said Letters Patent is hereby corrected as shown below:

On the title page "5 Drawing Figures" should read -- 27 Drawing Figures --.

Figure 2C:
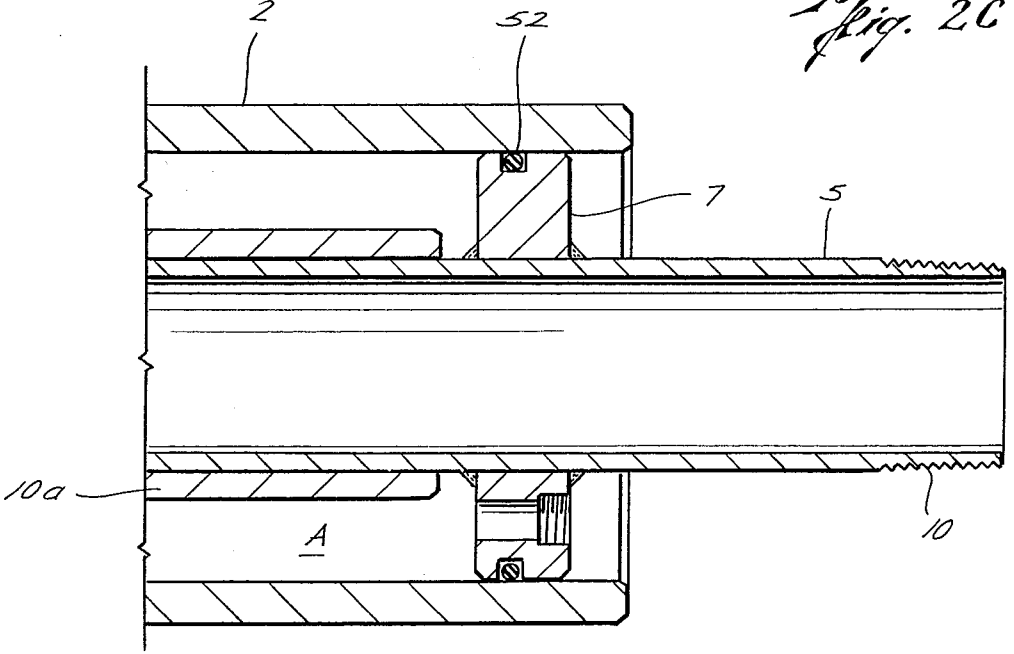

In the drawings, after figure 2C, add _ _Figures 3A, 3B, 3C, 3D, 3BB, 4A, 4B, 4C, 4D, 5, 6, 7, 8, 9, 10, 11, 12, 13, 14, 15, 16, and 17_ _ as shown on pages 2-10 hereof.

Column 4, line 68, substitute _ _other_ _ for "ohter".
Column 5, line 36, substitute _ _238_ _ for "239".
Column 7, line 41, substitute _ _therein_ _ for "thereon".
Column 8, line 27, substitute _ _452_ _ for "458".
Column 15, line 4, substitute _ _700D_ _ for "700B".
Column 22, line 23, substitute _ _higher_ _ for "hgher".

UNITED STATES PATENT AND TRADEMARK OFFICE

CERTIFICATE OF CORRECTION

PATENT NO. : 4,615,401

DATED : OCTOBER 7, 1986

INVENTOR(S) : WILLIAM R. GARRETT

It is certified that error appears in the above—identified patent and that said Letters Patent is hereby corrected as shown below:

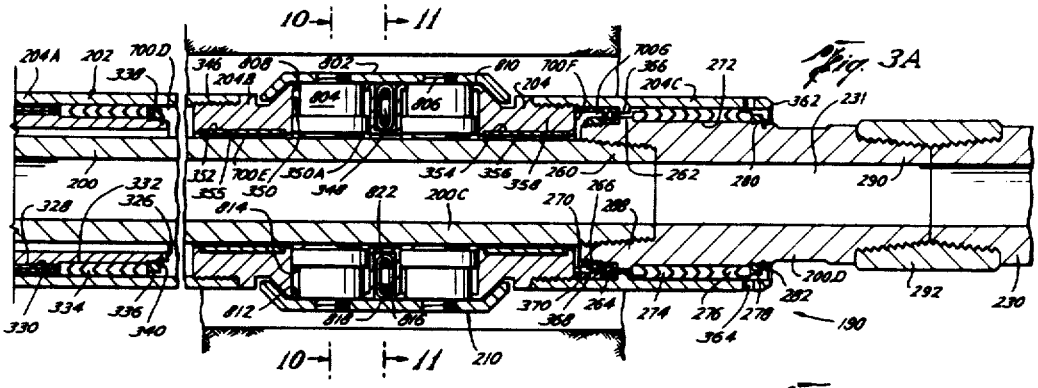

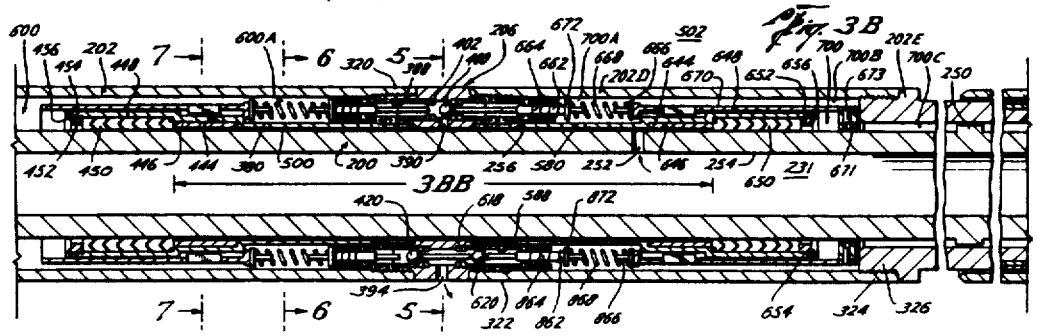

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

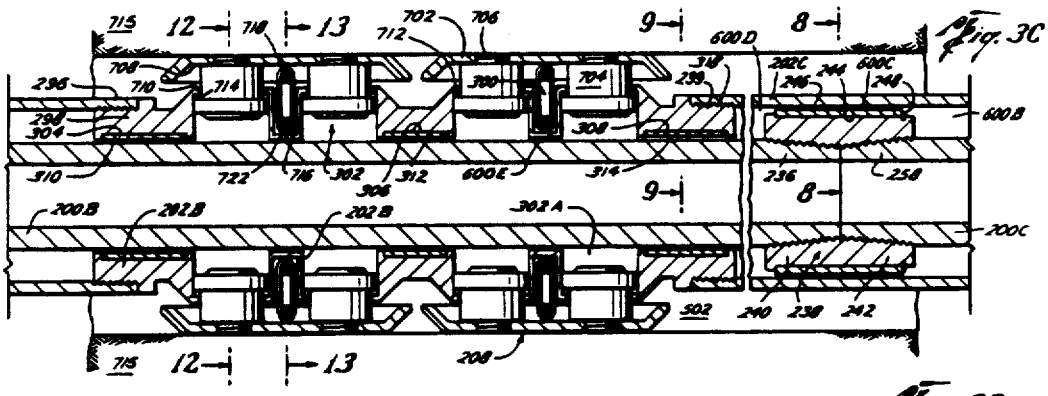

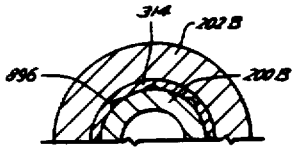

Fig. 9

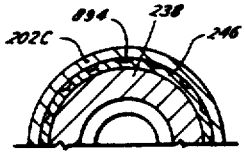

Fig. 8

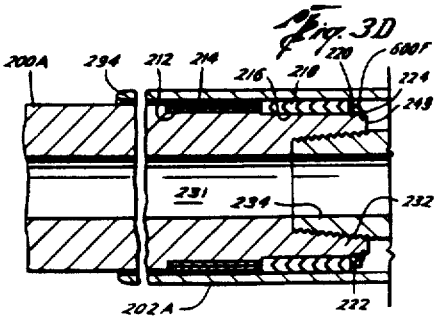

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

Fig. 3BB

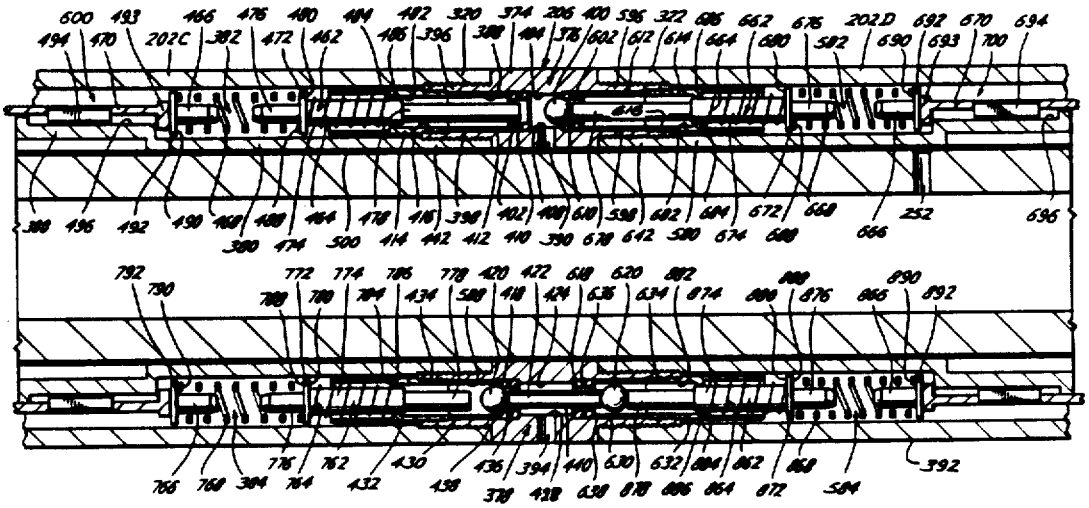

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

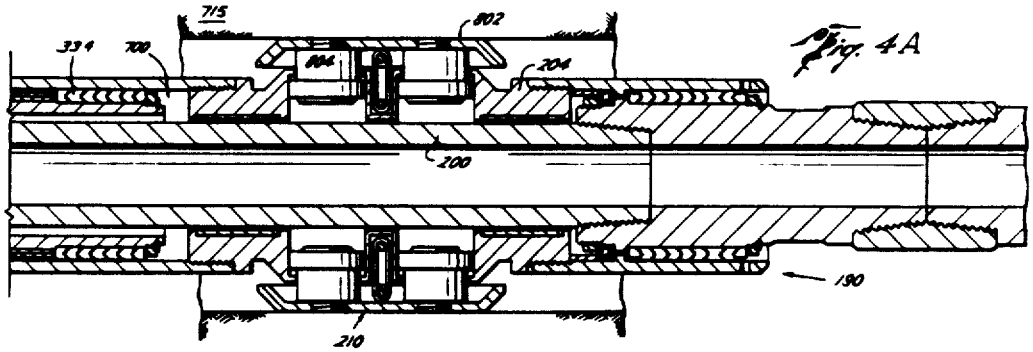

Fig. 4A

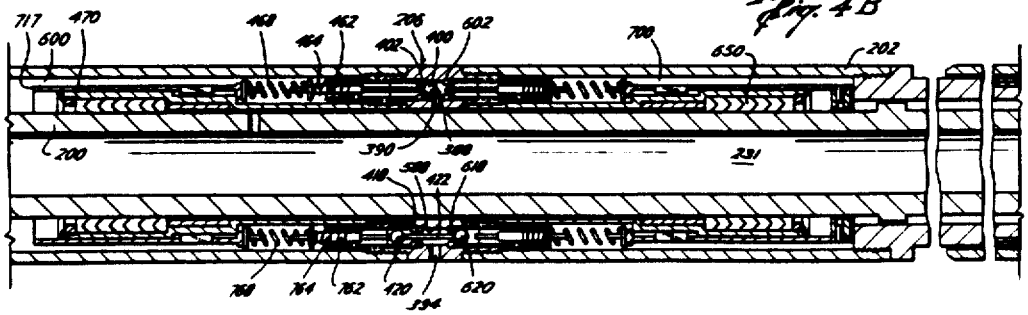

Fig. 4B

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

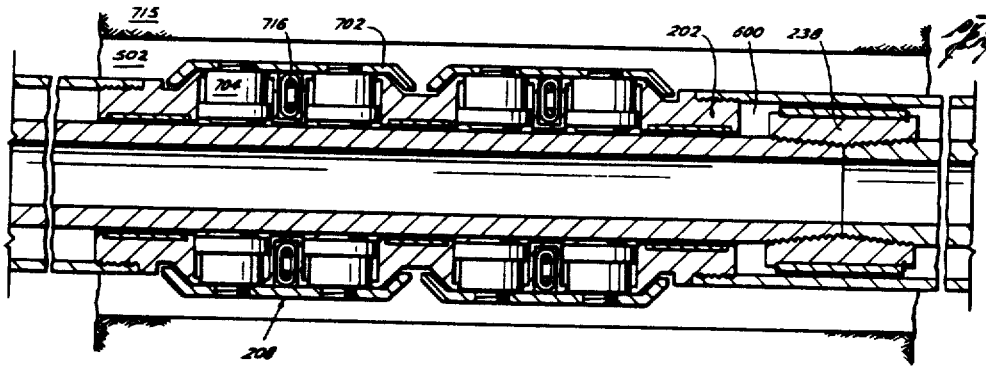

Fig. 4C

Fig. 15

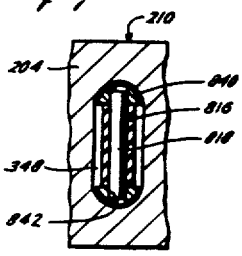

Fig. 14

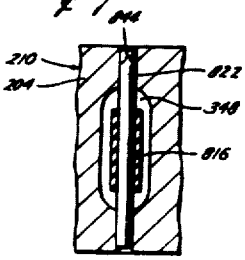

Fig. 4D

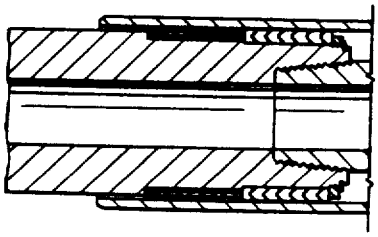

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

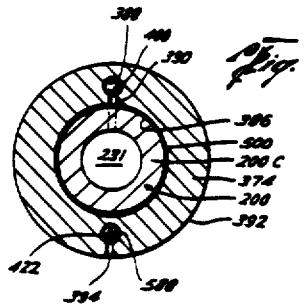

Fig. 5

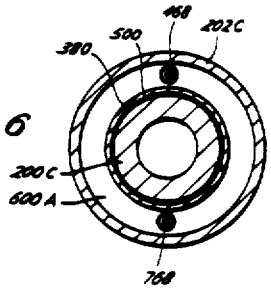

Fig. 6

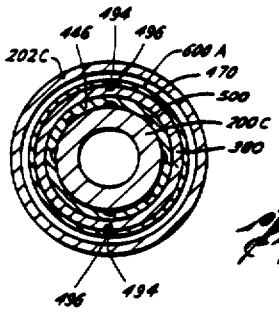

Fig. 7

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

Fig. 10

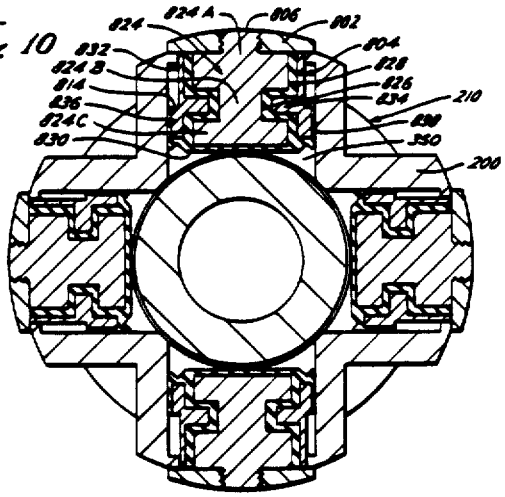

Fig. 11

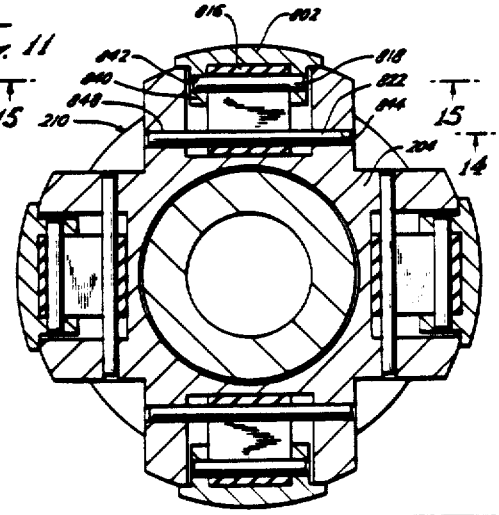

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

Fig. 12

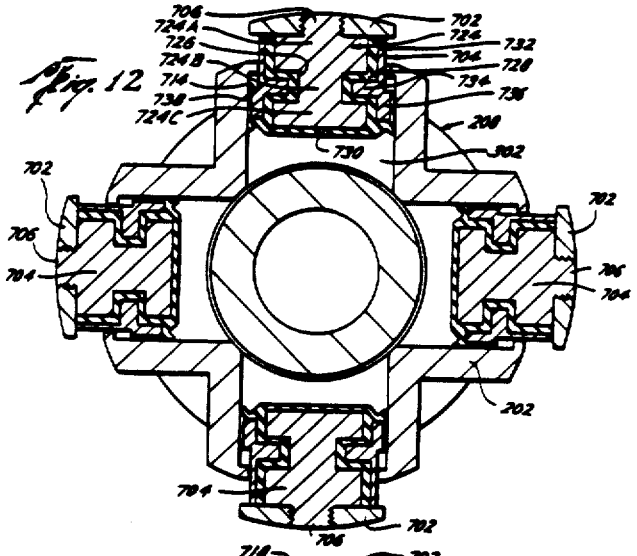

Fig. 13

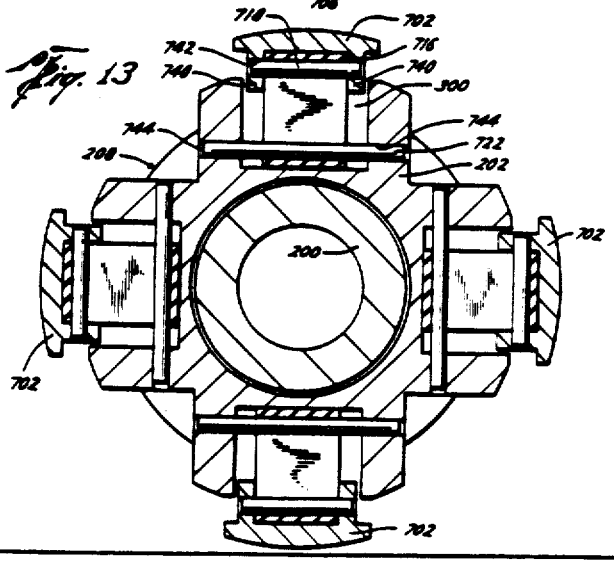

UNITED STATES PATENT AND TRADEMARK OFFICE

CERTIFICATE OF CORRECTION

PATENT NO. 4,615,401

DATED OCTOBER 7, 1986

INVENTOR(S) WILLIAM R. GARRETT

It is certified that error appears in the above—identified patent and that said Letters Patent is hereby corrected as shown below:

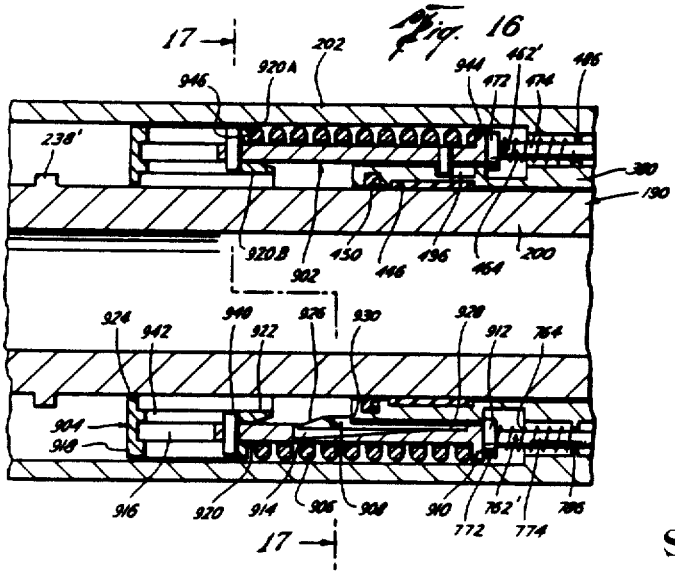

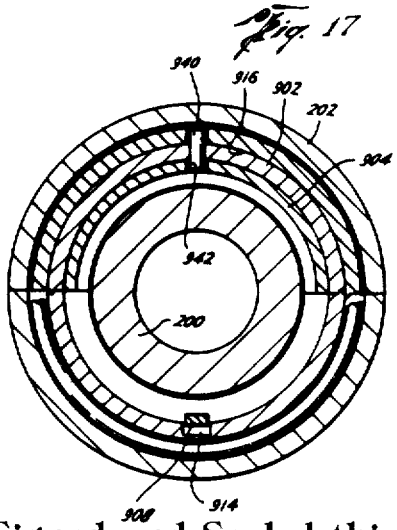

Signed and Sealed this

Sixth Day of December, 1988

*Attest:*

DONALD J. QUIGG

*Attesting Officer*

*Commissioner of Patents and Trademarks*